US008540077B2

(12) United States Patent
Yoshida et al.

(10) Patent No.: US 8,540,077 B2
(45) Date of Patent: Sep. 24, 2013

(54) COMPACT CASE BUILT-IN WITH HINGE UNIT AND METHOD OF MANUFACTURING COMPACT CASE BUILT-IN WITH HINGE UNIT

(75) Inventors: Yuzo Yoshida, Tokyo (JP); Michiaki Kumagai, Tokyo (JP); Yasuko Nakajima, Tokyo (JP)

(73) Assignee: Yoshida Industries Co., Ltd., Tokyo (JP)

( * ) Notice: Subject to any disclaimer, the term of this patent is extended or adjusted under 35 U.S.C. 154(b) by 0 days.

(21) Appl. No.: 13/578,762

(22) PCT Filed: Feb. 9, 2011

(86) PCT No.: PCT/JP2011/052715

§ 371 (c)(1),
(2), (4) Date: Aug. 13, 2012

(87) PCT Pub. No.: WO2011/099504

PCT Pub. Date: Aug. 18, 2011

(65) Prior Publication Data

US 2012/0305417 A1 Dec. 6, 2012

(30) Foreign Application Priority Data

Feb. 15, 2010 (JP) ..... 2010-029936
Jan. 14, 2011 (JP) ..... 2011-006111

(51) Int. Cl.
*A45D 33/24* (2006.01)

(52) U.S. Cl.
USPC ..... 206/581; 132/294; 220/810

(58) Field of Classification Search
USPC ..... 206/581, 823; 132/293, 294, 295; 220/810, 827, 830, 835, 836, 844; 53/396
See application file for complete search history.

(56) References Cited

U.S. PATENT DOCUMENTS

2003/0173369 A1* 9/2003 Nikolaus et al. ..... 220/830
2005/0178695 A1 8/2005 Petit (Continued)

FOREIGN PATENT DOCUMENTS

JP 11-230154 A 8/1999
JP 2000-022790 A 1/2000

(Continued)

OTHER PUBLICATIONS

International Search Report for PCT/JP2011/052715, ISA/JP, mailed May 24, 2011.

*Primary Examiner* — Jacob K Ackun
(74) *Attorney, Agent, or Firm* — Harness, Dickey & Pierce, PLC

(57) ABSTRACT

[Problem to be solved] To provide a compact case built-in with a hinge unit that can be easily assembled while reducing manufacturing costs of parts.

[Solving Means] A compact case 1 with a lid body 20 connected, in an openable and closable manner, via a hinge using at least one or more hinge unit 30, to a back end of a flat box shaped container body 10, the compact case includes a frame body 41 of a plate-like member having a flat shape along a peripheral shape of an upper opening of the container body, the back end of the container body is formed with a hinge storing section 11 for storing a case section of the hinge unit so that a shaft section of the hinge unit is protruded, a back end of the lid body is formed with a receiving hole 21*a* in which the shaft section of the hinge unit is to be inserted, the frame body is attached to the container body so as to cover up the hinge storing section, the shaft section of the hinge unit is inserted in the receiving hole in a state the case section of the hinge unit is fixed to the container body, and the container body and the lid body are connected in an openable and closable manner.

17 Claims, 19 Drawing Sheets

(56) References Cited

U.S. PATENT DOCUMENTS

| | | | | |
|---|---|---|---|---|
| 2010/0059081 | A1* | 3/2010 | Yoshida et al. | 132/287 |
| 2010/0258473 | A1* | 10/2010 | Breese | 206/581 |
| 2010/0275948 | A1* | 11/2010 | Parker | 132/293 |
| 2010/0294790 | A1* | 11/2010 | Lin | 220/810 |

FOREIGN PATENT DOCUMENTS

| | | | |
|---|---|---|---|
| JP | 2005-192709 | A | 7/2005 |
| JP | 2005-261729 | A | 9/2005 |
| JP | 2005-270299 | A | 10/2005 |
| JP | 2005-279145 | A | 10/2005 |
| JP | 2006-000515 | A | 1/2006 |
| JP | 2006-014895 | A | 1/2006 |
| WO | WO-2009-053682 | A2 | 4/2009 |

* cited by examiner

COMPACT CASE BUILT-IN WITH HINGE UNIT AND METHOD OF MANUFACTURING COMPACT CASE BUILT-IN WITH HINGE UNIT

CROSS-REFERENCE TO RELATED APPLICATIONS

This application is a 371 U.S. National Stage of International Application No. PCT/JP2011/052715, filed Feb. 9, 2011. This application claims priority to Japanese Patent Applications No. 2010-29936, filed Feb. 15, 2010 and 2011-6111, filed Jan. 14, 2011. The disclosures of the above applications are entirely incorporated herein by reference.

TECHNICAL FIELD

The present invention relates to a compact case with a container body that contains cosmetics and a lid body which are connected with a hinge, and methods of manufacturing the compact case.

BACKGROUND ART

The compact case has a hinge structure to cover with a lid body in an openable and closable manner an opening of a flat box-shaped container body to be a storage space of cosmetics and cosmetic tools. There is a compact case that is urged, with a special hinge structure, in a direction in which the lid body opens automatically when the lid body is opened to a certain angle or greater than such an angle, and that is urged in a direction in which the lid body closes when the angle is smaller than such an angle. Further, there are also compact cases that can hold the lid body at a predetermined angle in such a state. With such a compact case, it is not necessary to separately provide a mechanical structure (such as a hook) to maintain the lid body in a closed state, and the compact case has features that its opening and closing operation is easy and also has an excellent outer appearance.

With this type of compact case, the container body and the lid body are connected with a hinge (hereinafter referred as a hinge unit) that can control a rotational torque, in order to automatically open and close the lid body in accordance with the opening and closing angle. The hinge unit has generally a structure in which a shaft section is protruded from one end surface of a tubular case section to be rotatable about the axis of the tubular case section, and the case section contains therein a rotational torque control mechanism to control the rotational torque of the shaft section.

Note that, in PTLs 1 and 2 below are disclosed a structure of the hinge unit, and a structure of the compact case (compact case built-in with the hinge unit) using such a hinge unit. For example, the hinge in the compact case built-in with the hinge unit described in PTL 1 is a structure in which a hinge section of the container body is sandwiched by hinge sections of the lid body, both hinge sections are arranged coaxially, and the hinge unit is inserted toward the hinge section of the container body from the outer side of the hinge section of the lid body. That is, the case section of the hinge unit is inserted in the hinge section of the container body, and the shaft section of the hinge unit is protruded inside the hinge section of the lid body. Further, the hinge section of the lid body is closed up from the outer side with a cap member to fix the shaft section to the lid body. In this way, the shaft section of the hinge unit is fixed to the hinge section of the lid body, the case section is fixed to the hinge section of the container body, and the lid body and the container body are connected via the hinge unit.

Note that, the cap shaped part is fitted in the lid body so that the hinge unit itself does not inadvertently fall out of a through hole.

Further, with the compact case built-in with the hinge unit disclosed in PTL 3 below, a through hole is formed in the hinge section of the container body and a recessed receiving section is formed in the lid body, and the hinge section of the container body is positioned to the outer side of the hinge section of the lid body. With such a compact case built-in with the hinge unit, after inserting the hinge unit from the through hole and connecting the lid body and the container body, an opening of the through hole is closed up, and further a cover member forming a bottom surface of the compact case built-in with the hinge unit is assembled. In PTL 4 below, there is described a compact case with a built-in hinge unit that can make the tip end of the hinge unit be easily fitted in a hole formed in the container body or the lid body and in which workability is improved when assembling, by using the hinge unit that has a hemispheric tip end.

PRIOR ART LIST

Patent Literature

PTL1: JP-A-2005-270299
PTL2: JP-A-2005-279145
PTL3: JP-A-2005-261729
PTL4: JP-A-11-230154

SUMMARY OF INVENTION

Technical Problem

With the conventional compact case built-in with the hinge unit, it was necessary to separately manufacture and assemble the cap member in PLT1 or the cover member in PLT3, and therefore there was a problem that these processes further increased the cost of manufacturing the compact. Further, with the compact case disclosed in PTL 4, the tip end of the hinge unit is hemispheric, so that when a load is applied to the lid body in a direction in which it opens further than a position in which it is completely open, there was a problem that tip end section of a hemispheric shaft section will easily fall out of the receiving hole in the lid body.

Further, with a conventional compact case that connects the lid body and the container body via a different member such as a pin, without using the hinge unit, it was necessary to form through holes to insert the different member to the lid body or the container body, and a mold to injection mold the lid body or the container body needed a so-called slide mechanism to make a mold member that forms the through holes move in a perpendicular direction in respect to the opening and closing direction of the mold. Thus, there was a problem that the mold becomes complicated and large sized, and the mold cost and the shaping cost were increased.

An object of the present invention is to decrease a manufacturing cost of a compact case in which a lid body and a container body are connected via the hinge unit that provides self-closing ability and self-opening ability to the lid body in a certain opening and closing angle, by reducing the number of members, making the mold configuration simple, and also making the assembling work efficient. Note that, other objects will become clear in the below descriptions.

Solution to Problem

An aspect of the present invention to achieve the above advantages is a compact case built-in with a hinge unit, comprising a flat box shaped container body that stores cosmetics in a lower bottom part, a lid body connected to a back end of the container body by a hinge using at least one or more hinge unit, the lid body covering an upper surface opening of the container body in an openable and closable manner, the lid body being urged in a predetermined direction up to a predetermined opening and closing angle with a rotating torque controlling mechanism built-in the hinge unit, the compact case further comprising a frame body to be fixed to the container body, which is made of a plate-like member having a flat a peripheral shape to cover an upper opening of the container body;

wherein a shaft section of the hinge unit protrudes in an axial direction from a tip end side of the case section, wherein a hinge storing section for storing the case section of the hinge unit is provided at a back end side of the container body and partitioned with wall surfaces so that the shaft section is made to protrude therefrom, wherein a receiving hole is formed to the back end of the lid body into which the shaft section of the hinge unit is to be inserted, wherein the case section of the hinge unit is stored in the hinge storing section, the frame body is attached to the container body so as to cover up the hinge storing section, and the case section of the hinge unit is fixed to the container body, wherein the shaft section of the hinge unit is inserted in the receiving hole, and the container body and the lid body are connected in an openable and closable manner.

Note that, the hinge storing section may be partitioned with a wall surfaces standing upwards.

Further, the invention may be a compact case built-in with a hinge unit, wherein the shaft section is formed with an inclined surface in a downward direction toward a tip end;

an inside of the receiving hole is formed in a shape corresponding with the shape of the inclined surface; and the inclined surface of the shaft section is facing a direction in which the lid body is fitted to the container body, so as to insert the shaft section of the hinge unit in the receiving hole in an assembling process.

Alternatively, the invention can be a compact case built-in with a hinge unit, wherein the hinge unit has the shaft section protruding in an axial direction from a tip end of the case section, and a guide section at a distal end surface thereof which extends in a crosswise direction while passing through a rotational axis of the shaft section, wherein a plate-shaped tongue piece extending in a front-back up-down direction is provided suspending on a back end lower surface of the frame body, the tongue piece having a guide engaging section extending in the up-down direction and engaging with the guide section, wherein the receiving hole is provided at the back end of the lid body in which the shaft section is to be inserted, wherein the hinge storing section stores the hinge unit with the tip end surface in a state opposed to an opening of the receiving hole, and the tongue piece is inserted in a state with the guide engaging section engaged to the guide section in the distal end surface of the hinge unit, and the hinge unit has the shaft section inserted in the receiving hole in a state urged to the tip end side.

With any of the compact case built-in with a hinge unit, a hinge structure may comprise a section connected with an engagement of the hinge unit, and another section connected with an engagement of an engaging projection and an engaging recess. In this case, the engaging projection may be formed on a flexible piece which is placed on the container body along a rotating surface through which the lid body rotates by the hinge structure. Further, with a compact case built-in with a hinge unit, the frame body may be provided with a contact portion at the back surface thereof which fills a space adjacent to the flexible piece.

With a compact case built-in with a hinge unit that has the other end of the hinge section connected with engagement of an engaging projection and an engaging recess, the engaging projection may be formed with a columnar section on a side surface thereof, and the back surface of the frame body is formed with a contact section that comes into contact with the columnar section when assembling.

A compact case built-in with a hinge unit having a tongue piece on a lower surface of the frame body can be a compact case comprising two hinge units wherein, the tongue pieces are formed on the back end lower surface of the frame body spaced apart to the left and right and facing each other, and the guide engaging section is formed on the opposing side of each tongue piece, the lid body has the receiving hole in each of the left and right of the back end, the container body has two hinge storing sections spaced apart to the left and right at the back end thereof, the two hinge storing sections individually store the two hinge units such that the tip ends are facing each other or that the distal end surfaces are facing each other, each hinge unit being inserted in the receiving hole so that each shaft section is coaxial with one another.

A compact case built-in with a hinge unit having a tongue piece on a lower surface of a frame body may be a compact case wherein the guide engaging section is a protrusion extending downwards, and the guide section is a groove extending in the up-down direction in a state stored in the hinge unit section. In this case, the guide engaging section may have an inclined section at the lower end thereof which gradually decreases in height in protrusion toward the lower end thereof.

A compact case built-in with a hinge unit having a tongue piece on a lower surface of a frame body may be a compact case wherein the guide engaging section is a groove that extends downwardly, and the guide section is a protrusion that extends in the up-down direction in a state stored in the hinge unit section. In this case, the guide section may have an inclined section which gradually decreases in height in protrusion toward the upper end thereof.

With a compact case built-in with a hinge unit having a tongue piece on a lower surface of a frame body, the case section and the shaft section of the hinge unit can be arranged coaxially, and both are square tubular shapes having a substantially square end surface, and the guide section is formed in a cross shape so as to halve each side of the substantially square shape of the case section.

A manufacturing method of a compact case built-in with a hinge unit in which a tip end section of a hinge unit has an inclined shape is also within the scope of range of the invention, and the manufacturing method of the compact case comprising steps of:

mounting a case section of the hinge unit to the container body in such a manner that the inclined surface of the tip end portion of the shaft section faces an upper side of the container body; and assembling the lid body to the container body such that the hinge section of the lid body presses the tip end portion of the shaft section from an upper to a back direction.

The manufacturing method may further comprise a step of mounting a frame body that stores cosmetics to the container body, after mounting the case section of the hinge unit to the container body or after the assembling step.

The present invention further covers a manufacturing method of a compact case built-in with a hinge unit having a tongue piece on a lower surface of a frame body, comprising steps of:

a first step of storing the hinge unit in the hinge storing section so that an extending direction of the guide section faces in the up-down direction;

a second step of assembling the lid body to the container body while opposing the opening of the receiving hole and a tip end of the shaft section of the hinge unit; and a third step of inserting the frame body to the container body by pushing the frame body from above such that the tongue piece is inserted to the hinge storing section and that the guide engaging section is engaged with the guide section of the hinge unit stored in the hinge storing section, whereby the hinge unit is urged toward the direction of the tip end and the tip end of the shaft section of the hinge unit is inserted to the receiving hole.

Advantageous Effects of Invention

With the compact case built-in with the hinge unit of this invention, there is no need to use part or member which is provided with through hole to insert the hinge unit, and the structure of the mold can be simplified. Further, the manufacturing cost of the part can be reduced, and assembly becomes easy. As a result the manufacturing cost of the compact case can be reduced.

DESCRIPTION OF EMBODIMENTS

Technical Idea of the Invention

With a conventional compact case built-in with a hinge unit, it was necessary to provide a complex slide mechanism in a mold, when molding structural parts. Therefore, the costs relating to the mold itself or the servicing and maintenance of the mold were increased. For this reason, the inventors of this application first considered to reduce the cost relating to the mold by eliminating through hole to insert the hinge unit. Further, an undercutting process, particularly the design of the mold using an inclined pin that will cause trouble, is decreased as much as possible. Thus, a new design principle is introduced in which, in the assembling of the compact case built-in with the hinge unit, the case part of the hinge unit can be easily assembled without using the through hole, more preferably, the compact case can be assembled by just "placing" the case part of the hinge unit on top.

Namely, in addition to the demand to significantly decrease the cost of the mold, there was also a demand to significantly decrease the cost of assembly by just mounting the case part of the hinge unit in a predetermined direction. This invention was made as a result of continued diligent research based on such demands.

First Embodiment

<Schematic Structure of Compact Case>

Figure 1:
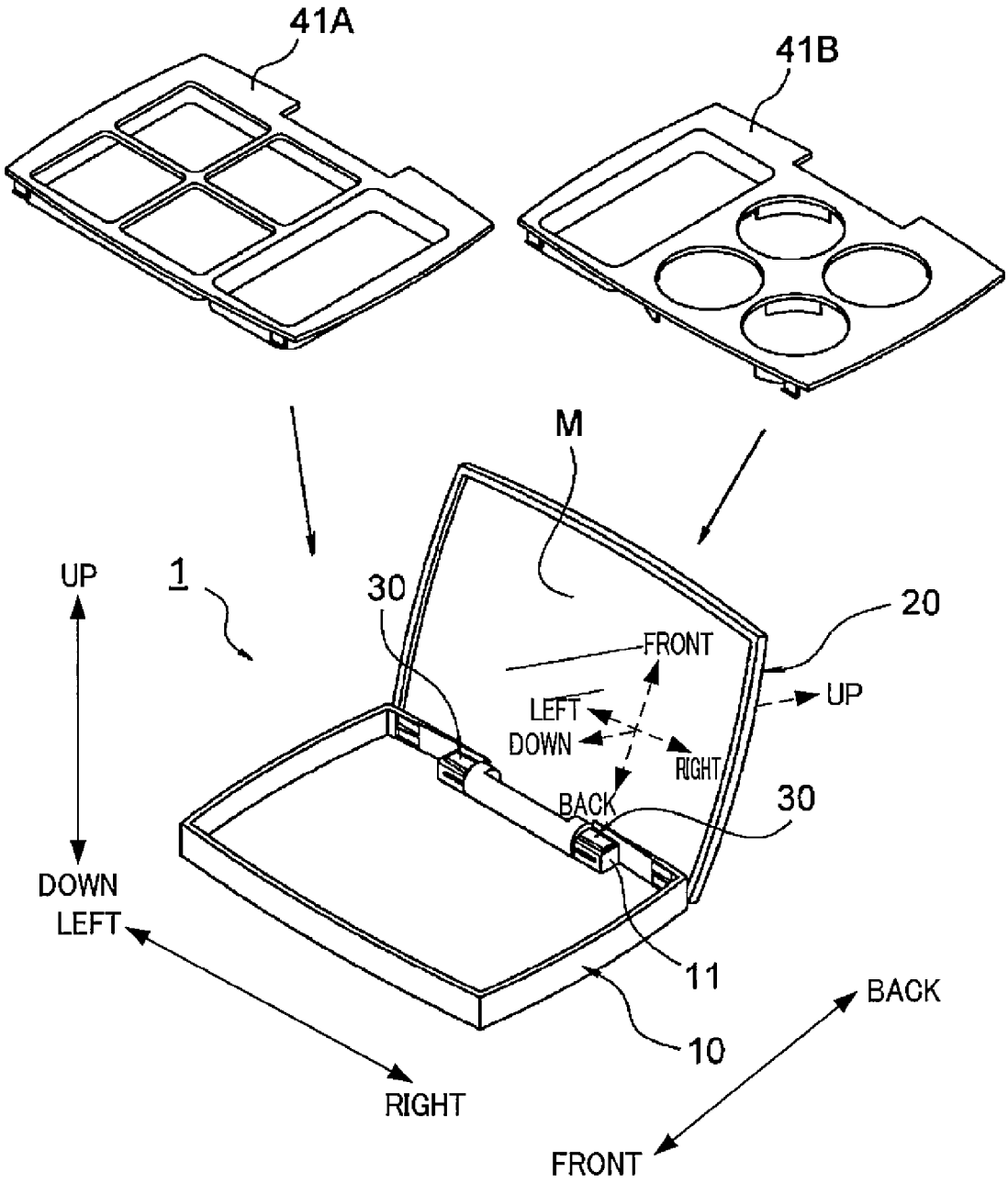
FIG. 1 is a perspective view of a compact case of a first embodiment of the present invention.

FIG. 1 is a perspective view showing a structure of a compact case built-in with a hinge unit in a first embodiment of the present invention. The compact case 1 built-in with the hinge unit includes a container body 10 that stores cosmetics, a lid body 20 to be the lid, and hinge units 30 that connect the container body 10 and the lid body 20 in an opening and closing manner. Note that, the container body 10 selectively holds a frame body (41A or 41B and the like) that stores the cosmetics in accordance with the type of the cosmetics.

In this way, the compact case built-in with the hinge unit of the present invention has the same external appearance as the conventional compact case. However, the compact case of the present invention has features in the shape of the hinge units 30 and the assembling structure of the hinge units 30. Therefore, in addition to the advantages of the conventional compact case built-in with the hinge unit (ease of opening and closing the lid body, superior outer appearance and the like), the present invention does not need dedicated parts required conventionally, such as the cap shaped parts, and the parts with the through hole which made the manufacturing process complex, and also the present invention make the assembly of the hinge units easy and accurate.

Here, regarding the compact case built-in with the hinge unit of the embodiments of this invention, including the first embodiment, each direction in an up-down direction, a left-right direction, and a front-back direction is defined for convenience. Here, as shown in FIG. 1, regarding directions of the container body 10 of the compact case 1, the container body has a bottom surface as a lower side, an opening to be covered with the lid body 20 as an upper side, and a direction that intersects the up-down direction of the container body 10 as a horizontal direction. Further, a side that is connected with a hinge to the lid body 20 is a back side, and the open end side of the lid body 20 is a front side. The horizontal direction when seen from the front side is adopted as the left-right direction. On the other hand, regarding the lid body 20, since it has an opening-closing action, with a closed state as the reference, other than the left-right direction, the up-down and the front-back directions are each defined, regardless of each of the open and closed states. Namely, when the lid body 20 is in a closed state, each direction of the lid body 20 and the container body 10 match. In the figure, the directions relating to the lid body 20 are shown by dotted line arrows. Below, the features of the compact case 1 of the first embodiment are described in more detail.

The lid body 20 holds a mirror M on its inner side. The hinge units 30 are fit from above into a groove-shaped hinge storing sections 11 positioned to the back of the container body 10. Note that, in the conventional assembling process, in order to assemble or insert the case section of the hinge unit in the hole, an operation to move it in the axial direction was necessary. But in this embodiment, a hole to assemble the case section of the hinge unit is not provided, and the moving operation in its axial direction is eliminated, and the assembling operation itself can be simplified.

Of course, each hinge storing section 11 can be provided with an opening at the front end side thereof by covering a part or all of the top section so that the hinge unit 30 can be inserted into the hinge storing section from the front side thereof. The opening of the hinge storing section 11 may be provided with a fitting rib and the like with which it is easy to position and which can prevent falling out. In the case where the inserting of the hinge unit in the up-down direction is difficult, the hinge unit can be inserted from the axial direction.

Next, each member of the compact case 1 is specifically described. FIG. 2 is a fragmented perspective view of the compact case of the first embodiment, FIG. 2A is a perspective view of each member of the compact case 1, and FIG. 2B is an enlarged view of the hinge unit 30.

Figure 2A:
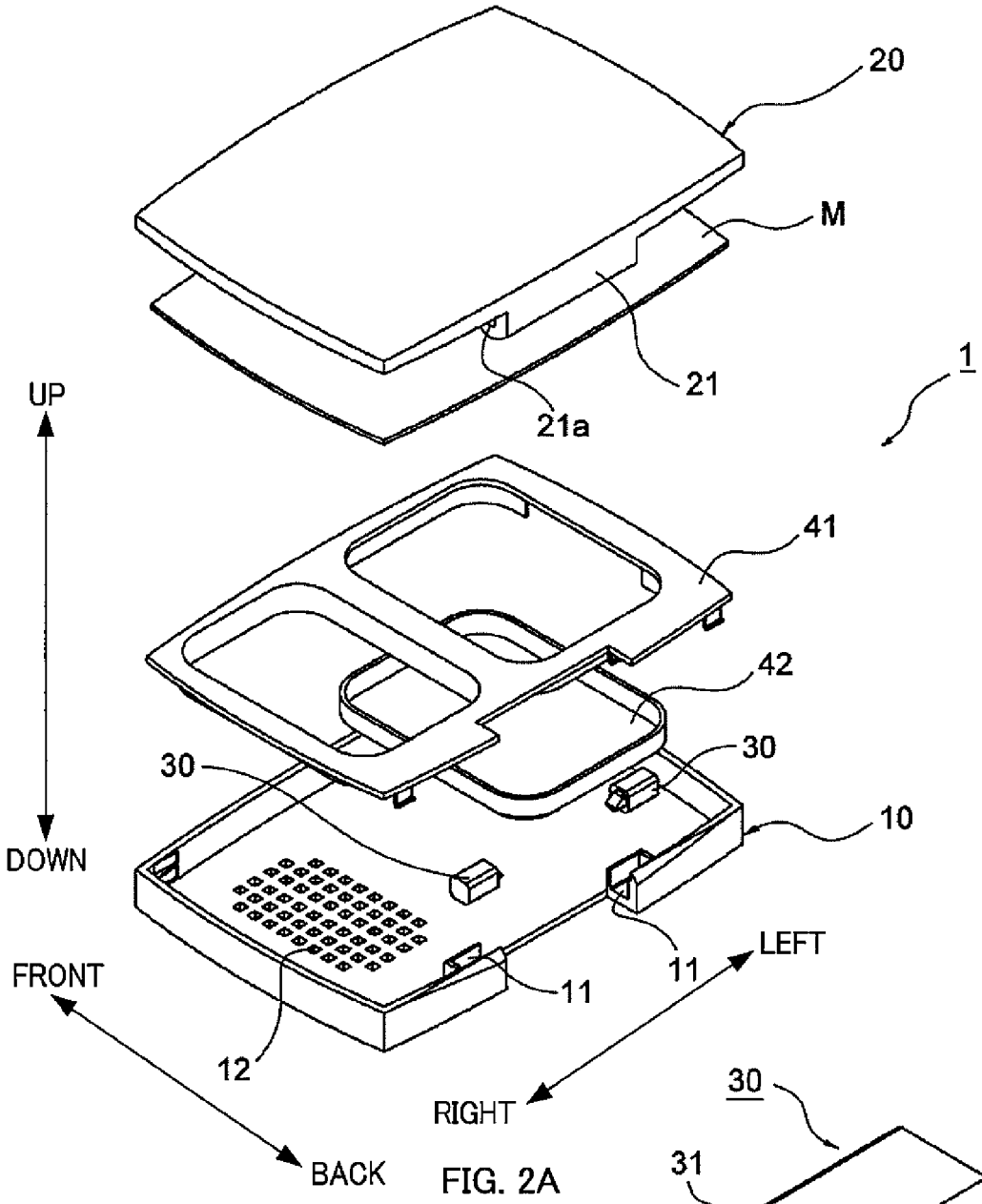
FIGS. 2A-2B are fragmented perspective views explaining each member of the compact case of the first embodiment.

As shown in FIGS. 1 and 2A, the container body 10 is formed with hinge storing sections 11 that hold the hinge units 30. Further, a back end of the lid body 20 is formed with a hinge projection 21 that structures a part of the hinge using the hinge units 30. The hinge projection 21 is formed protruding so as to extend to the left and right in the center of the back end of the lid body 20, so that when attached with hinges to the container body 10 via the hinge units 30, the section 21 is arranged to the inner side than the hinge storing sections 11 of the container body 10. Therefore, the openings of the hinge storing sections 11 are formed so that tip end sections of the hinge units 30 face one another toward the inner side of the container body 10.

Further, the container body 10 is fitted in with a cosmetic plate 42, in accordance with the characteristics of the cosmetics, and a frame body 41. The frame body 41 covers up the exposed upper surfaces of the hinge units 30 that have been inserted in the hinge storing sections 11, and also is fixed to the container body 10 to prevent falling off of the hinge units. Note that, the container body 10 shown here is formed with mesh holes 12 to provide air permeability. Further, some container bodies do not have the mesh holes depending on the type of the cosmetics and the cosmetic tools (puff and sponge). The inside shape of the frame body 41 can be hollow shape with side walls, with the side walls and the bottom of the container body 10 defining a space formed by the cosmetic plate 42.

Figure 2B:
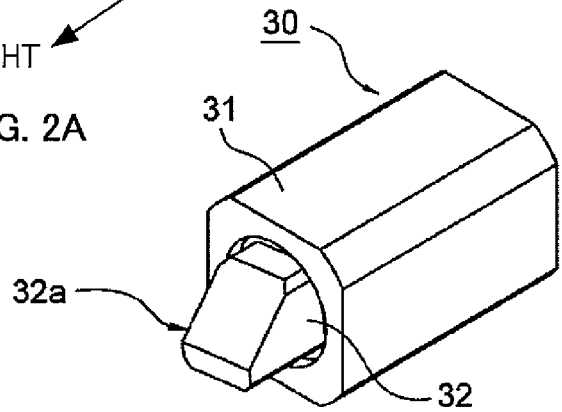

As shown in FIG. 2B, each hinge unit 30 is structured from a case section 31 and a shaft section 32. The case section 31 is engagingly fixed or mounted to the hinge storing section 11 of the container body 10. Further, the shaft section 32 is formed rotatably in respect to the case section 31. Inside the case section 31 is arranged an elastic member (not shown) to urge the shaft section 32 to the tip end thereof. Thus, when the tip end section 32*a* is pressed, the shaft section 32 can move to an internal direction of the case section 31 along a rotation axis.

Further, in the first embodiment, the tip end section 32*a* of the shaft section 32 is formed in an inclined shape so that an inclined surface faces a direction in which the lid body 20 can be fitted to, when fixing the lid body 20 to the container body 10. On the other hand, the hinge projection 21 of the lid body 20 is formed with a receiving hole 21*a* in which the tip end section 32*a* of the shaft section 32 is fitted. This receiving hole 21*a* is formed in a recessed shape corresponding to an inclined shape of the tip end section 32*a* of the shaft section 32. The internal shape of the receiving hole 21*a* may be a completely identical inclined shape so that it completely fits the inclined shape of the tip end section 32*a* of the shaft section 32, but it is not limited thereto, and it may be a shape in which the tip end section does not come off when there is an impact on the compact case 1. Namely, the internal shape of the receiving hole 21*a* can be other shapes, as long as, after the tip end section 32*a* of the shaft section 32 is fitted, the rotating operation of the shaft section 32 and the rotating operation of the lid body 20 are linked, and the tip end section does not come off when used ordinarily.

<Assembly Procedure>

Figure 3A:
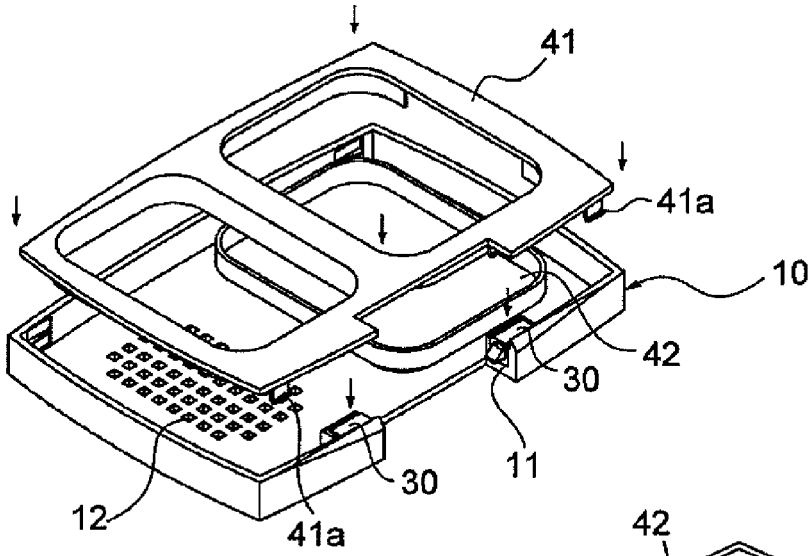
FIG. 3A-3C are perspective views explaining a manufacturing process of the compact case of the first embodiment.
Figure 3B:
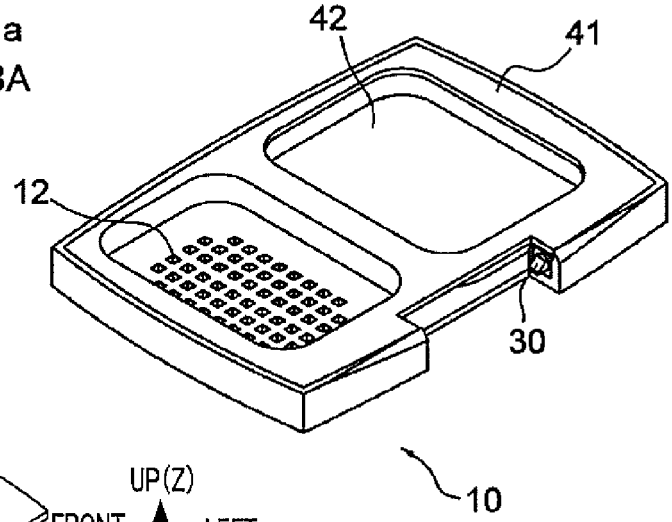
Figure 3C:
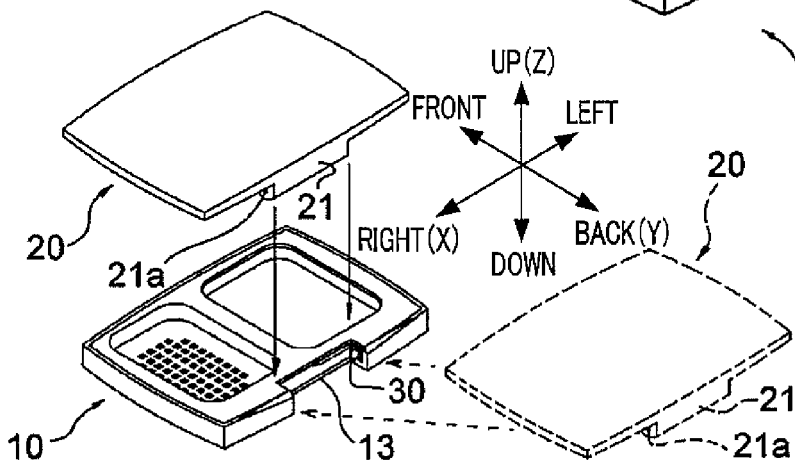

As a manufacturing method of the compact case 1, an assembly procedure of the compact case 1 of the first embodiment is shown in FIG. 3. FIG. 3A is a figure showing a state in which the hinge units 30 are attached to the container body 10, and FIG. 3B is a figure showing a state in which the frame body 41 and the cosmetic plate 42 are fitted into the container body 10. Then, FIG. 3C is an explanatory view of attaching the lid body 20 to the container body 10. First, as shown in FIG. 3A, the hinge units 30 are inserted from above the hinge storing sections 11 of the container body 10. Specifically, each case section 31 of the hinge unit 30 is fixed to the hinge storing section 11, in a state shown in FIG. 2B, namely so that the inclined surface of the tip end section 32*a* of the shaft section 32 is positioned to face a surface side of the container body 10 (the side to which the lid body 20 is to be arranged) (a case section fixing process).

Thereafter, as shown in FIG. 3B, the cosmetic plate 42 is placed on the container body 10, engaging hooks 41*a* of the frame body 41 are engaged to the container body 10, and the frame body 41 is assembled to the container body 10 (a frame body assembling process). Thus, the hinge units 30 and the hinge storing sections 11 are covered up with the frame body 41. Note that, the assembly method of the container body 10 and the frame body 41 is not limited to the method of engagement using hooks and the like, and for example, they can be adhered with ultrasonic welding and the like. Of course, the cosmetic plate 42 can be assembled after the frame body 41 has been assembled to the container body 10.

Finally, when the lid body 20 to which a mirror M is fixed to the inner side is connected to the container body 10, the compact case 1 is completed. Specifically, as shown in FIG. 3C, while the upper surface side of the container body 10 is facing upwards, the hinge projection 21 of the lid body 20 is pressed from above to the hinge recessed section 13 of the container body 10 (in the solid arrow direction in the figure). Then, each tip end section 32*a* of the shaft section 32, with its elasticity, is temporarily pressed down with the hinge projection 21, and then recovers to the projecting position. Then, in this way, each tip end section 32*a* of the shaft section 32 of the hinge unit is fitted in the receiving hole 21*a* of the hinge projection 21, and the lid body 20 and the container body 10 are connected (a connecting process).

Note that, the direction in which the lid body 20 is pressed to the container body 10 is not necessarily from above, and as long as it is an angle in which the fitting can be easily performed when assembling, the lid body 20 can be pressed from any angle from the upper to the back side of the container body 10. Here, as shown in FIG. 3C, since the left-right, front-back, and up-down directions are corresponding with the XYZ coordinates, when the angle relating to the above fitting is considered, the hinge projection 21 can be connected to the hinge recessed section 13 from any direction (a position of the lid body 20 shown by broken lines in the figure) of a normal direction of a Y axis and a Z axis on a YZ plane. Note that, in this case the inclined surface of the tip end section 32*a* of the shaft section 32 of the hinge unit 30 is preferably faced in a direction from the upper to the back side as described above.

Further, in this embodiment, the assembling process is described in the order of the step of fixing hinge units to the case body, the step of assembling the frame body and the case body and the step of connecting the lid body to the case body, but it is not limited thereto. For example, the container body 10 and the lid body 20 can be assembled, after the hinge unit 30 is engaged to the container body 10, and finally the frame body 41 can be assembled to the container body 10. Namely, the processes can be in the order of hinge units fixing step, the case body and lid body connecting step, and the frame body assembling step. The assembly process can be the same in the below embodiments.

Then, with the compact case 1 having the above structure and configuration, any process of fixing the hinge units to the case body, assembling the frame body and connecting the lid body to the case body can be performed only by the actions in the up-down direction (Z direction) in FIG. 3C. In particular, when assembling the hinge units 30, there is no need to perform the assembling operation in the axial direction (X direction) of the hinge section as needed conventionally. Namely, the hinge storing sections 11 of the container body 10 are open upwards, so that only by the up-down operation, the hinge units 30 can be assembled to the hinge storing sections 11, and the lid body can be connected to the hinge units by the operation of the lid body. Thus, the workability in the assembling process is improved, and the assembling work of the compact case can be made more efficient. Note that, when the container body 10 and the lid body 20 are connected by selecting an angle in which they are easily connected corresponding to the shape of the compact case 1, the assembling work can be made further more efficient.

Further, when the hinge units 30 are assembled to the hinge storing sections 11, as the inclined surface of the tip end section 32*a* of each shaft section 32 is facing the direction in which the lid body 20 is to be assembled, the tip end section 32*a* is pressed by the hinge projection 21. Therefore, the hinge projection 21 comes into contact with the inclined surface, and the tip end section 32*a* is smoothly pressed downwards. Thus, the assembling of the container body 10 and the lid body 20 becomes easy, and the assembling work of the compact case 1 can be performed more efficiently.

It is not necessary to form through holes in the container body 10 and the frame body 41 to insert the hinge unit 30 from the X direction, and a cap member and a cover member to cover the through hole are not necessary after all. Further, it is not necessary to form the through holes in the mold either, thus the container body 10 and the frame body 41 can be formed by the extremely simple molds. Therefore, the mold manufacturing cost and the molding time can be reduced.

Since the compact case has such structure that the container body 10 and the lid body 20 are connected first via the hinge units 30 and thereafter the frame body 41 can be assembled, compact cases preliminary assembled by connecting the container body 10 and the lid body 20 can be prepared in advance, and afterwards as necessary a variety of frame bodies 41 corresponding to the cosmetics to be stored can be set, thus shortening the producing period of the compact case 1 and handling changes in quantity.

Further, since the tip end section 32*a* of the shaft section 32 is shaped to incline in one direction, the tip end section 32*a* can easily be fitted in the receiving hole 21*a* to make the assembly easy, and also when a strong load is applied in the direction to open the lid body 20 excessively, the tip end section 32*a* of the shaft section 32 does not escape from the receiving hole 21*a* of the lid body 10, and the lid body 20 does not easily fall off. Namely, the assembled state can be maintained more strongly.

Second Embodiment

Figure 4:
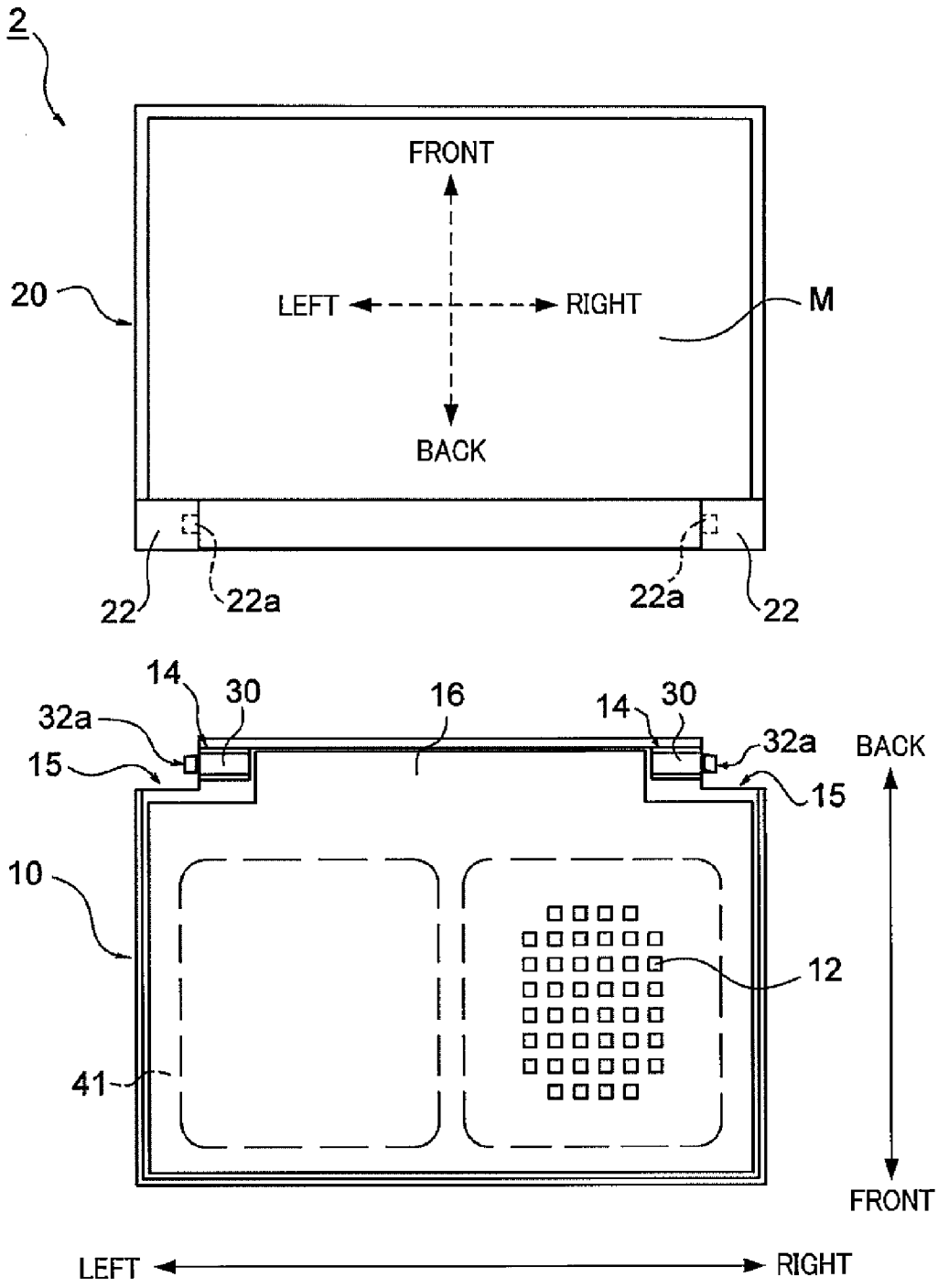
FIG. 4 is a fragmented plan view explaining a structure of a compact case of a second embodiment of this invention.
Figure 5:
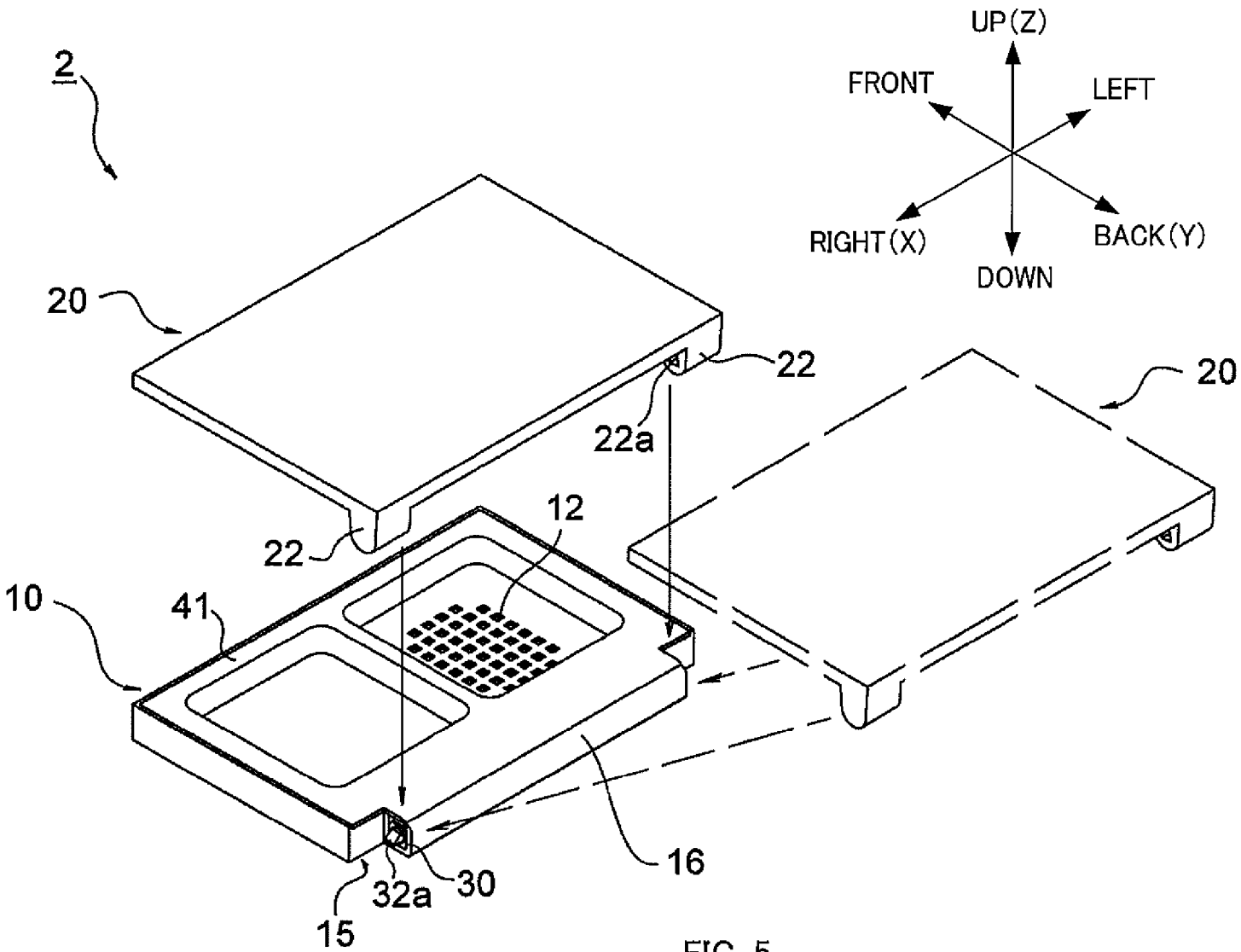
FIG. 5 is a fragmented perspective view explaining a structure and a method of assembling the compact case of the second embodiment.

FIG. 4 shows a plan view of a structure of a compact case 2 of a second embodiment of this invention. Further, FIG. 5 shows a fragmented perspective view of the structure of the compact case of the second embodiment. Now, a specific structure and configuration of the compact case 2 of the second embodiment is explained. Note that, in all the following figures, including FIGS. 4 and 5, the same or approximately the same structure as the compact case 1 of the above described first embodiment have the same reference numerals.

As shown in FIGS. 4 and 5, the compact case 2 of this embodiment has a structure in which, to the back side, the lid body 20 is attached with a hinge from the outer side to the container body 10. Namely, the hinge projections 22 formed at two places to the back side of the lid body 20 are located to the outer side than the hinge storing sections 14 formed at two places to the back side of the container body 10.

As the assembling procedure of the compact case 2 of this second embodiment, as shown in FIG. 4, first the hinge units 30 are inserted from above the hinge storing sections 14 of the container body 10. Then, similar to the above described embodiment, each hinge unit 30 is fixed so that the inclined surface of the tip end section 32*a* of the shaft section 32 faces an upper surface side of the container body 10 (a side to which the lid body 20 is to be arranged) (a case section fixing process). Thereafter, the frame body 41 is engagingly fixed to the container body 10, so that the container body 10 is completed (frame body assembling process).

Next, the lid body 20 is fixed to the container body 10. Specifically, as shown in FIG. 5, while the container body 10 is temporarily placed in a state facing upwards, the hinge projection 22 of the lid body 20 are pressed to the hinge recessed sections 15 of the container body 10 from above (a solid line arrow direction in the figure). Then, as in the above described embodiment, the tip end sections 32*a* of the shaft sections 32 of the hinge units 30 are fitted in the receiving holes 22*a* in the side surfaces of the hinge projection 22. Thus, the lid body 20 and the container body 10 are connected (a connecting process).

Note that, in this case, the direction in which the lid body 20 is pressed to the container body 10 does not necessarily have to be from above (Z axis direction), and as long as it is an angle in which the lid body 20 can be easily fitted into when being manufactured, the lid body 20 can be pressed from any direction from the upper side to the back side of the container body 10 (from the Z axis direction to the Y axis direction).

In this way, the compact case 2 of the second embodiment has a different outer appearance from the compact case 1 of the first embodiment, and the compact cases of the embodiments of this invention can have a degree of freedom in design. Of course, the compact case 2 in the second embodiment also has the function/effect of the compact case 1 in the above described first embodiment.

Third Embodiment

Figure 6:
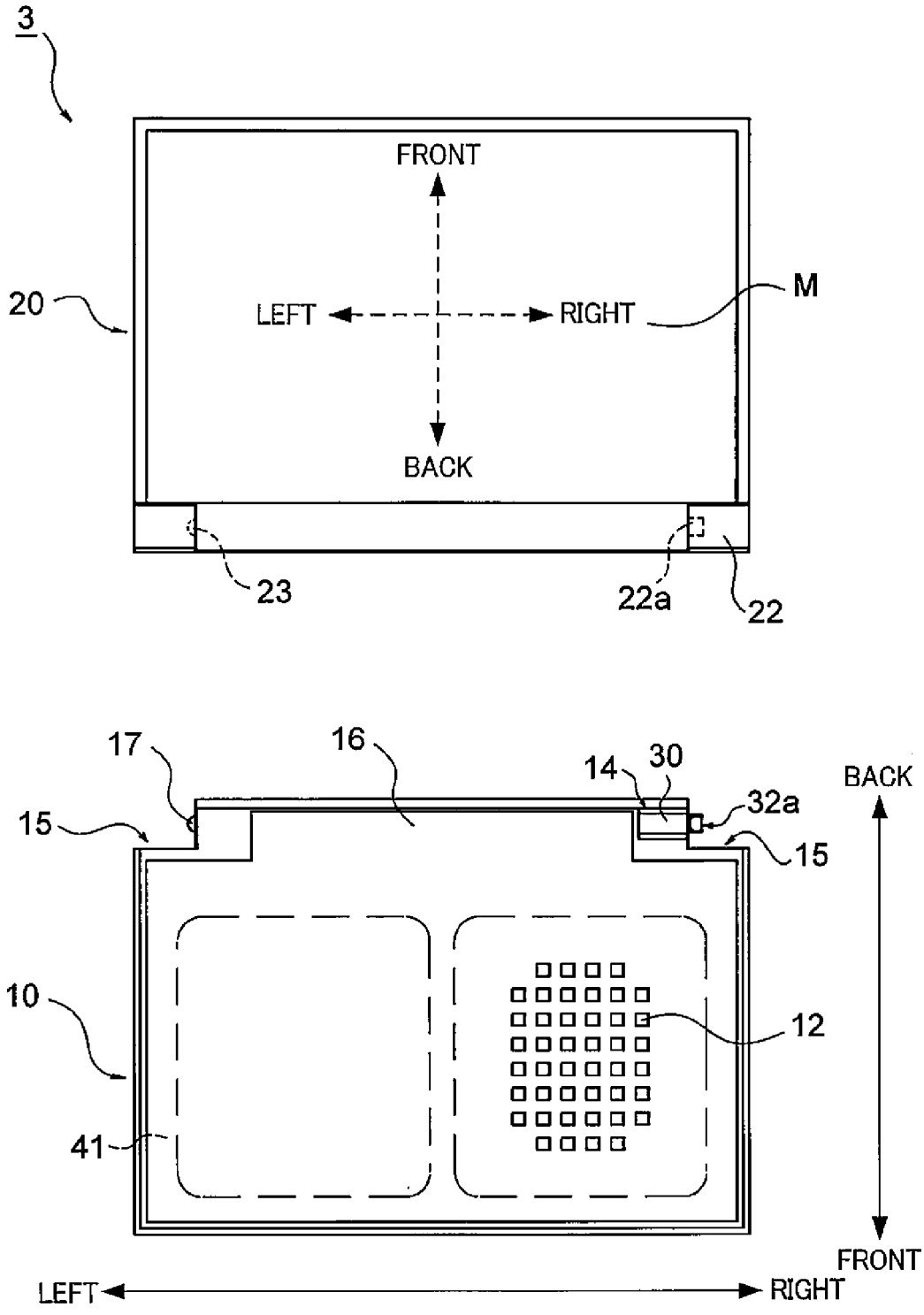
FIG. 6 is a fragmented plan view explaining a structure of a compact case of a third embodiment of this invention.

In the compact case of the first and second embodiments, two hinge units 30 were used, but the number of the hinge unit 30 does not necessarily have to be two. As the compact case of a third embodiment of this invention, the compact case using only one hinge unit is provided. FIG. 6 shows a figure to explain the structure of a compact case 3 of the third embodiment. The compact case 3 illustrated here has a structure in which the lid body 20 is attached with a hinge from the outer back side to the container body 10. As shown in FIG. 6, one hinge projection 16 of the container body 10 has a hinge storing section 14 to which the hinge unit 30 is fitted, and the other hinge projection 16 of the container body 10 has an engaging projection 17. The engaging projection 17 is hemispheric and the like and is engaged to an engaging recessed section 23 formed in one of the hinge projection 22 of the lid body 20 so as to structure the hinge.

Note that, with the compact case 3 of the third embodiment shown here, the engaging projection 17 is provided to the container body 10, and the engaging recessed section 22 is provided to the lid body 20, but it is not limited thereto, and the engaging recessed section can be provided to the container body 10 and the engaging projection can be provided to the lid body 20.

Fourth Embodiment

Figure 7A:
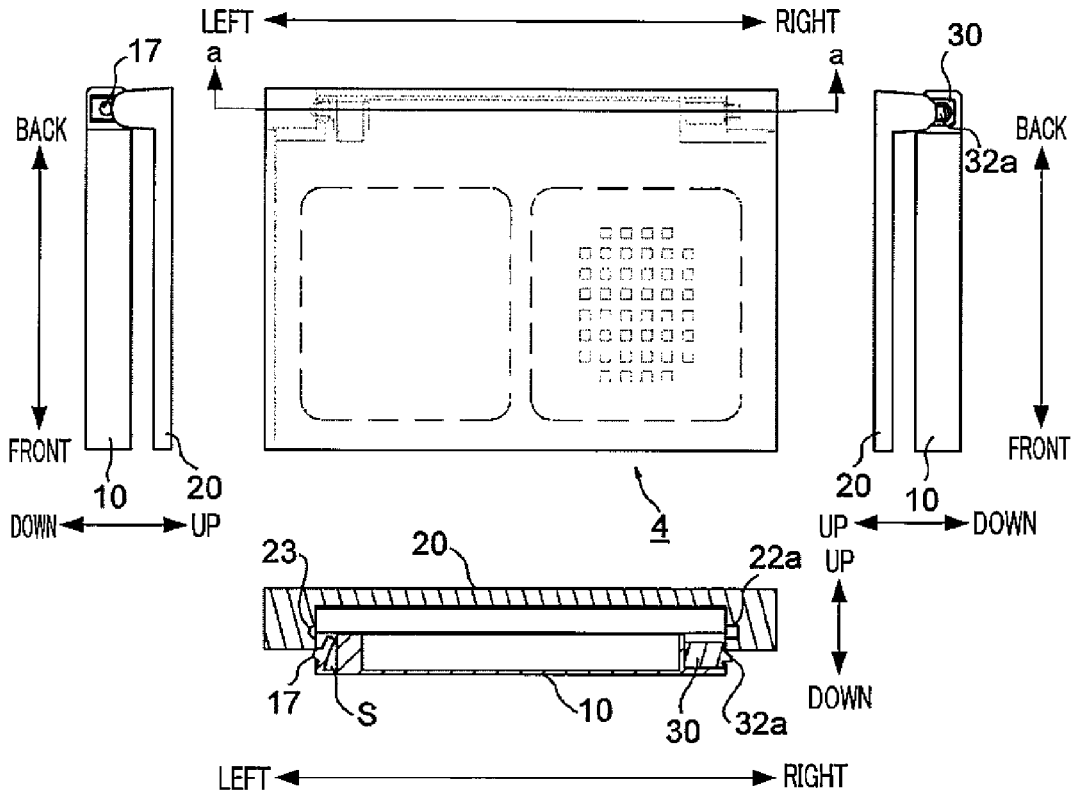
FIGS. 7A-7B are views explaining a structure of a modified example of a compact case of a fourth embodiment of this invention.
Figure 7B:
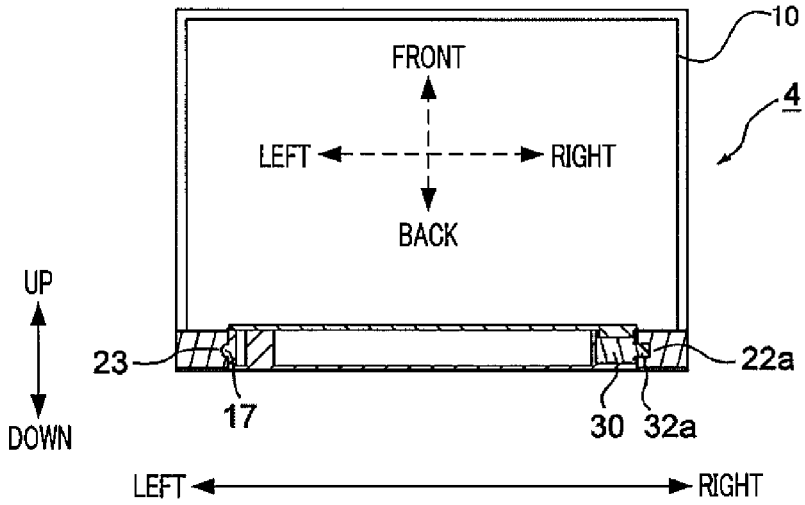

A compact case of a fourth embodiment of this invention is a modified form of the compact case 3 of the third embodiment. FIG. 7 shows a structural view of a compact case of the fourth embodiment. FIG. 7A is a view of a state immediately before the container body 10 and the lid body 20 are assembled, and shows an a-a arrow sectional view. Further, FIG. 7B is a view corresponding to a state in which the container body 10 and the lid body 20 are assembled. This compact case 4 has a structure in which the lid body 20 is connected with a hinge to the container body 10 at the back side thereof from the outer side thereof. As shown in FIG. 7A, there is a space S adjacent to the engaging projection 17 of the container body 10. Namely, the engaging projection 17 is formed on a flexible piece adjacent to the space S. Therefore, when assembling the container body 10 and the lid body 20, the engaging projection 17 is made to bend inwards in the space S. Thus, not only the hinge unit 30, but also the engaging projection 17 becomes easy to assemble, and the workability of assembling the container body 10 and the lid body 20 is further improved. Further, a larger projection than the engaging projection 17 of the third embodiment can be formed, and the engaging amount with engaging recessed section 23 can be made larger.

Fifth Embodiment

Figure 8A:
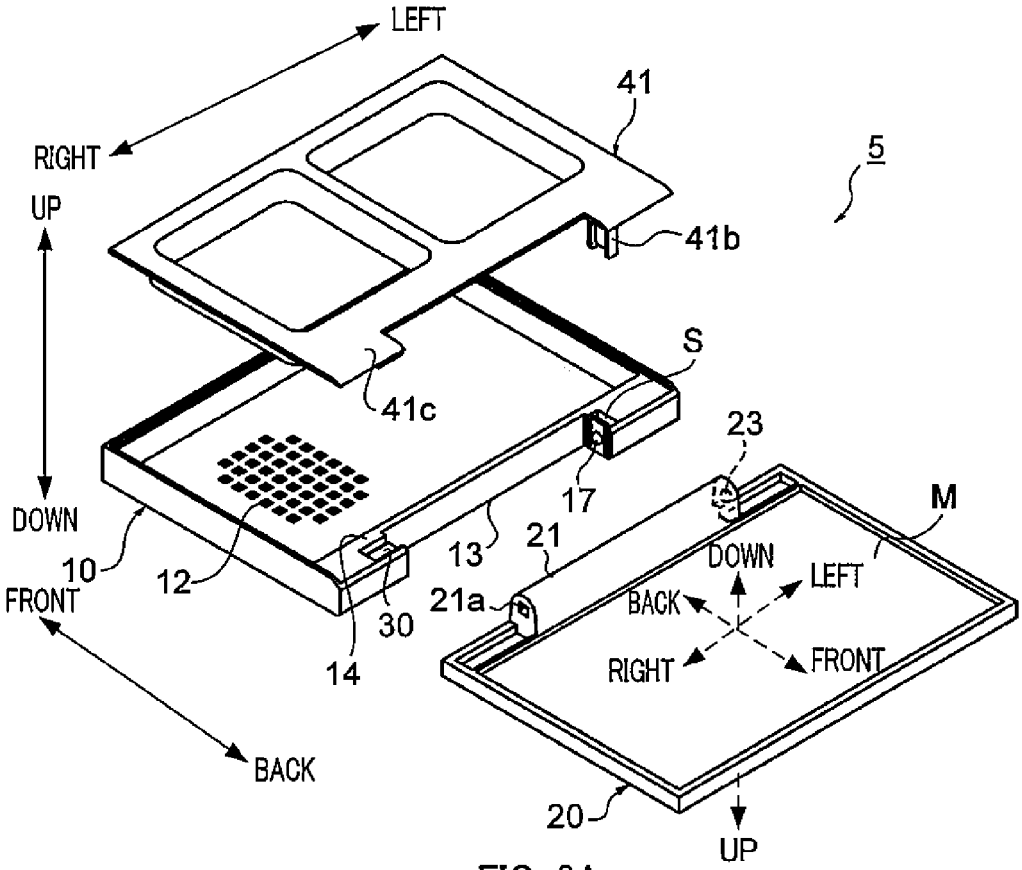
FIGS. 8A-8C are views explaining a structure of a compact case of a fifth embodiment of this invention.
Figure 8B:
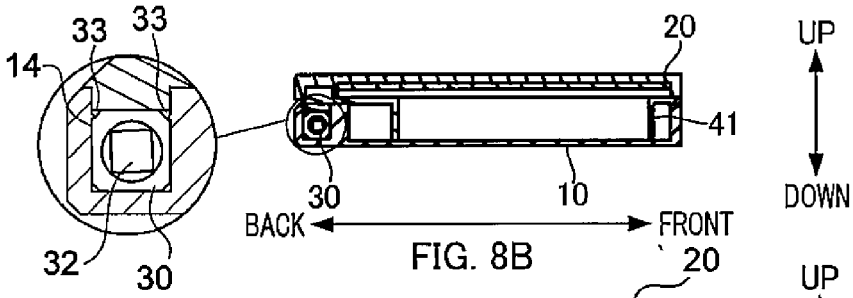
Figure 8C:
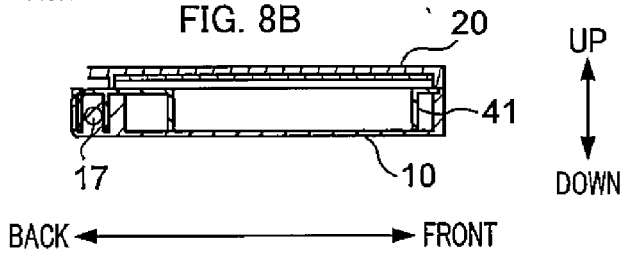

A compact case of a fifth embodiment of this invention is also a modified form of the compact case 3 of the third embodiment. FIG. 8 shows a structure of a compact case 5 of the fifth embodiment. FIG. 8A is a fragmented perspective view of the overall compact case 5, and FIG. 8B is a sectional view of a hinge section to a hinge unit 30 side. Note that, in FIG. 8B, for convenience of explanation, a part of the hatching has been omitted. FIG. 8C is a sectional view of the hinge section to the engaging projection 17 side. As shown in FIG. 8, the compact case 5 of this embodiment has a structure in which a lid body 20 is attached with a hinge from an inner back side to a container body 10, and has a structure in which a hinge projection 21 of the lid body 20 is assembled to a hinge recessed section 13 of the container body 10. Further, it has a structure having a space S, similar to the compact case 4 in the fourth embodiment.

Specifically, one end of the hinge recessed section 13 of the container body 10 is engaged with the hinge unit 30 having a tip end section 32*a* facing the inner side. Further, another end of the hinge recessed section 13 of the container body 10 is provided with an engaging projection 17 on a flexible piece and a space S is formed adjacent to the flexible piece. Thus, the flexible piece on which the engaging projection 17 is formed is made to bend in the space S when assembling. Further, as shown in the enlarged view of FIG. 8B, ribs 33 are formed to an upper section of the hinge storing section 14. By forming the ribs 33 in this way, the hinge unit 30 becomes hard to fall off after being fitted in the hinge storing section 14, and is surely secured inside the hinge storing section 14. Therefore, with the compact case 5 of the fifth embodiment, the hinge unit 30 can be more firmly fixed to the container body 10.

As the assembly procedure of the compact case 5 of this fifth embodiment, since the hinge projection 21 of the lid body is provided with a receiving hole 21*a* at one end thereof in which the tip end section 32*a* of the shaft section 32 of the hinge unit is to be fitted, and also since the hinge projection 21 is provided with an engaging recessed section 23 at the other end thereof to be engaged with the engaging projection 17 of the case body, the container body 10 and the lid body 20 are assembled at first. Thereafter, the frame body 41 is assembled to the container body 10. At this time, a back surface of the frame body 41, namely a contact section 41*c* on the lower surface thereof comes in contact with the hinge unit 30 and covers the upper section thereof, and a contact piece 41*b* on the lower surface of the frame body 41 enters in the space S. When the contact piece 41*b* enters the moving space S and fills the space S, the position of the engaging projection 17 is fixed, and the container body 10 and the lid body 20 can be firmly assembled.

Sixth Embodiment

Figure 9:
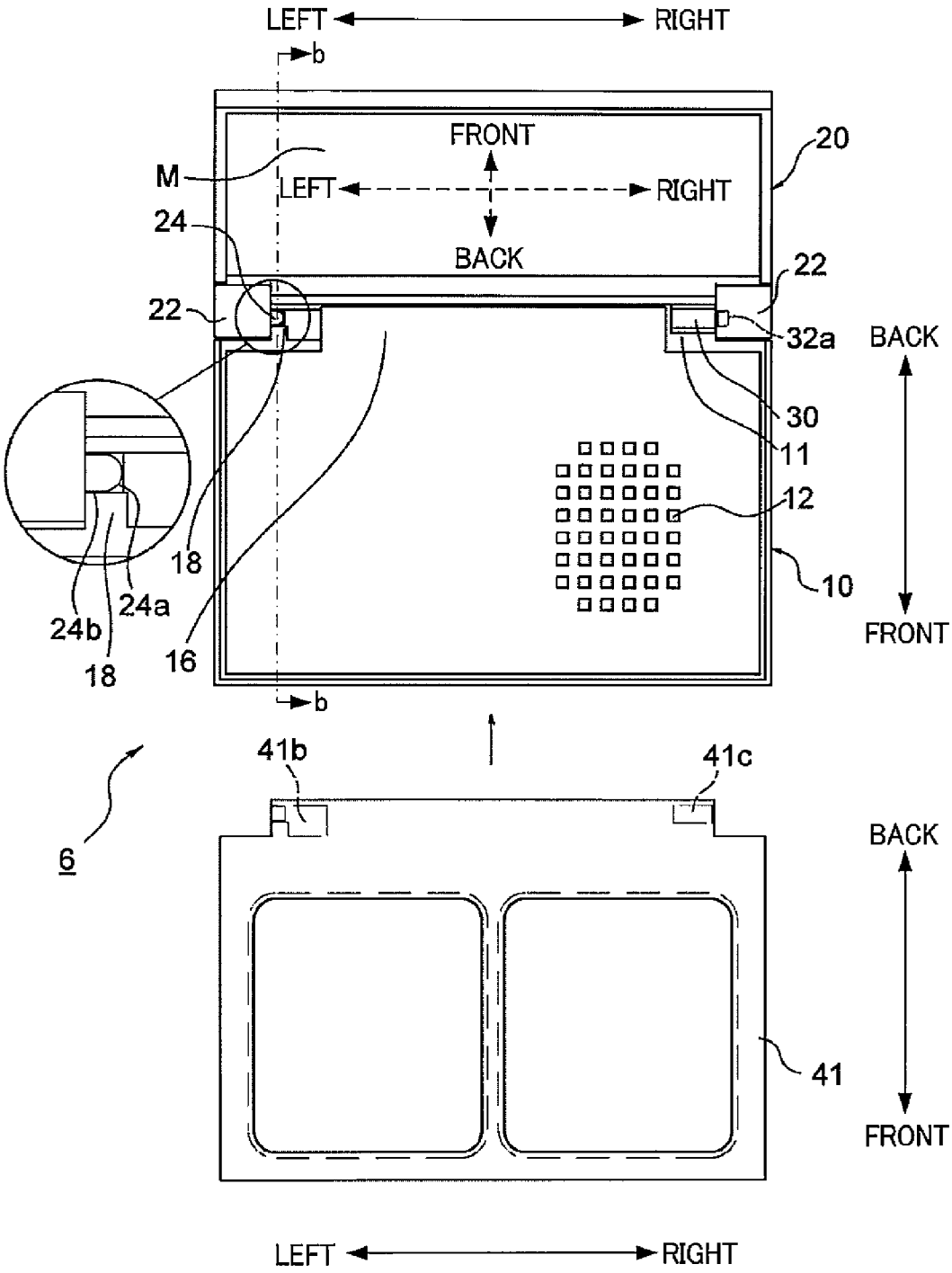
FIG. 9 is a fragmented top view explaining a structure of a compact case of a sixth embodiment of this invention.
Figure 10:
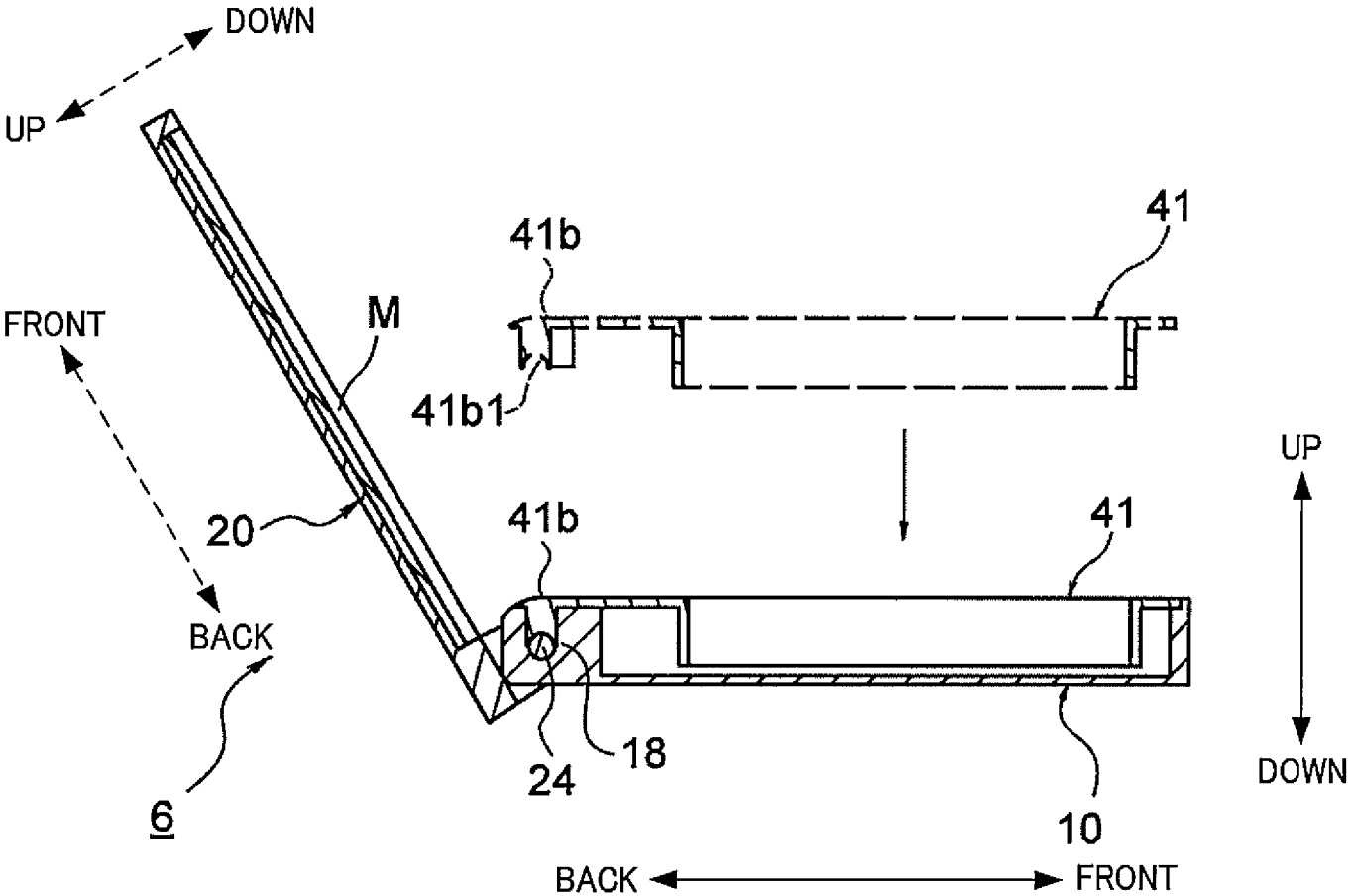
FIG. 10 is a sectional view explaining the structure of the compact case of the sixth embodiment.

FIG. 9 shows a top view of a structure of a compact case 6 of a sixth embodiment of this invention. Further, FIG. 10 shows a sectional view of the compact case 6. Note that, the compact case 6 in FIG. 10 corresponds to the sectional figure of the assembled compact case seen along b-b arrow in FIG. 9. The compact case 6 of the sixth embodiment is of a structure having a hinge projection 16 at a rear center of the container body 10 and having two hinge projections 22 at both rear end sections of the lid body 20. The lid body 20 is connected with hinges from the outer back side to the container body 10. Further, the compact case 6 has a hinge unit 30 and an engaging projection 24 similar to those in the third to fifth embodiments. Note that, in the sixth embodiment, the engaging projection 24 is formed on the lid body 20.

Further, the compact case 6 has an engaging recessed section 18 on a left end of the hinge projection 16 of the container body 10 and a hinge storing section 11 on a right end thereof. The hinge unit 30 is fitted in the hinge storing section 11. The engaging projection 24 is formed to one side of the hinge projection 22 of the lid body 20. As shown enlarged in a circle in FIG. 9, the engaging projection 24 is shaped with hemispherical tip end on a cylinder and therefore comprises a cylindrical section 24*b* and a hemispheric section 24*a*. Note that, though the engaging projection 24 is formed integrally with the hinge projection 22, a separate member of a similar shape can be used, for example a synthetic resin or a metallic pin with high wear resistance can be inserted in a hole which will be formed in the hinge projection 22.

The frame body 41 is fixed so as to cover the container body 10 from above. As shown in FIG. 10, on the lower surface of the frame body 41, the section that covers the engaging recessed section 18 from above is formed with a contact section 41*b* that comes into contact with an upper section of the engaging recessed section 18 of the container body 10 and covers it. The contact section 41*b* is formed with a sliding groove 41*b*1 that comes into contact with and along a side surface of the cylindrical section 24*b* of the engaging projection 24. When the frame body 41 is fixed to the container body 10, the sliding groove 41*b*1 and the cylindrical section 24*b* engage, and therefore resistance is added to the cylindrical section 24*b*. Further, as shown in FIG. 9, on the lower surface of the frame body 41 that covers the hinge unit 30 from above, a contact section 41*c* that comes into contact with the hinge unit 30 is formed.

As an assembly procedure of the compact case 6 with such a structure, after the container body 10 and the lid body 20 are assembled, the frame body 41 is fitted in the container body 10. Then, the contact section 41*b* of the frame body 41 comes into contact with the engaging recessed section 18 of the container body 10 and covers it from above, and the contact section 41*c* of the frame body 41 comes into contact with the hinge unit 30 of the container body 10 and covers it from above. The compact case 6 is completed in this way.

With the compact case 6 of the sixth embodiment with the above described structure and configuration, as shown in FIG. 10, since the sliding groove 41*b*1 of the contact section 41*b* of the frame body 41 comes into contact with the cylindrical section 24*b* which is a side surface of the engaging projection 24, when opening and closing the lid body 20, the cylindrical section 24*b* slidingly moves in between the sliding groove 41*b*1 and the engaging recessed section 18, and as a result a resistance to the lid body 20 occurs. Thus, the ability to stop the lid body at any angle, which maintains the lid body 20 at a predetermined open-close angle in respect to the container body 10, can be given not only to the end section in which the lid body 20 is engaged with the hinge unit 30, but can also be given to the end section that engages with the engaging projection 24. Note that, the cylindrical section 24*b* of the engaging projection 24 may be a shape having a partially large diameter section for example, a spindle shape and the like.

Seventh Embodiment

Figure 11A:
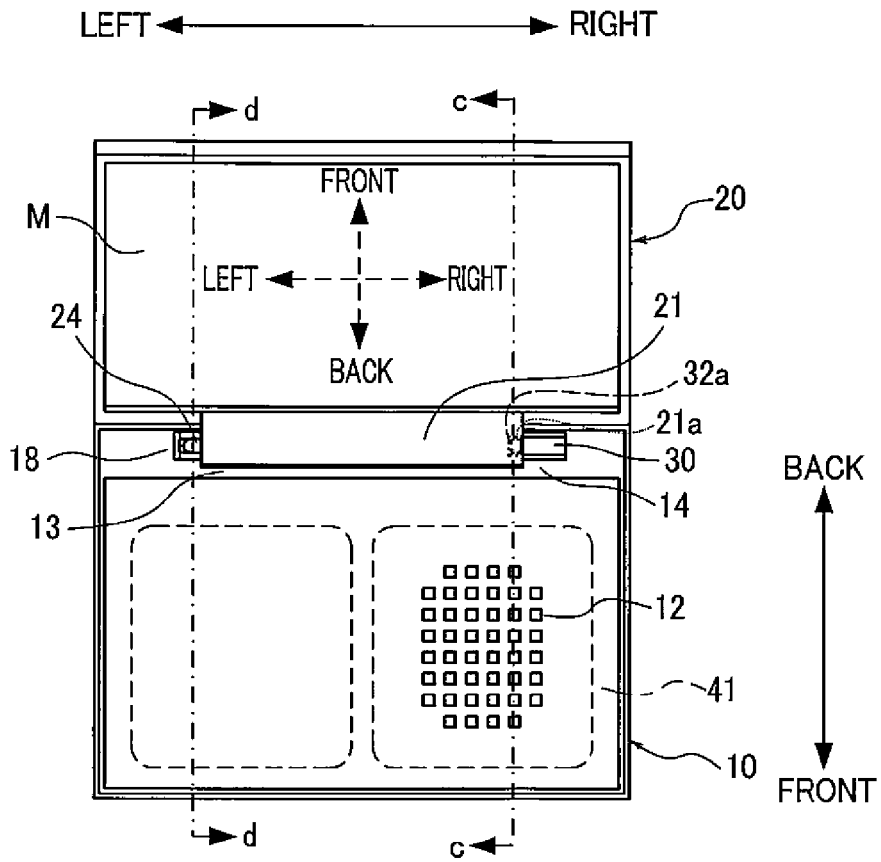
FIGS. 11A-11C are views explaining a structure of a compact case of a seventh embodiment of this invention.
Figure 11B:
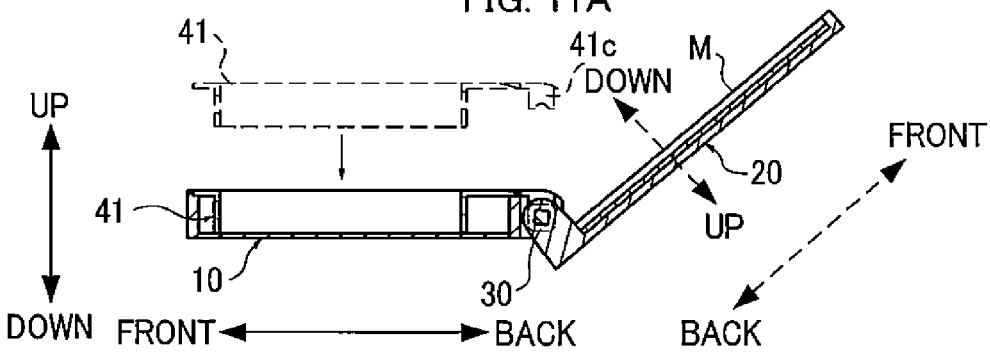
Figure 11C:
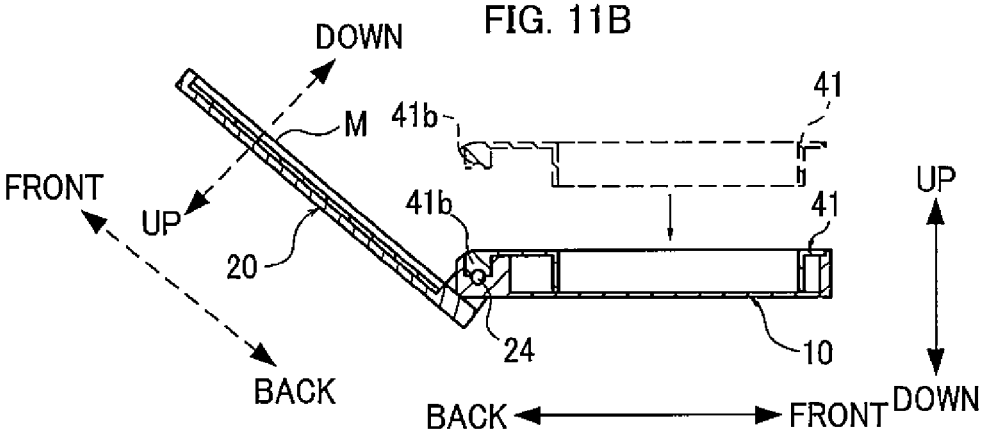

A seventh embodiment of this invention corresponds to a modified example of the compact case 6 of the sixth embodiment and uses the same hinge unit 30 while having sufficient ability to stop the lid body at any angle. A structure of a compact case 7 of the seventh embodiment is shown in FIG. 11. FIG. 11A is a plan view of the compact case 7 seen from above in which a lid body 10 is open, and FIG. 11B is a sectional view corresponding to a c-c arrow in FIG. 11A. FIG. 11C shows a sectional view corresponding to a d-d arrow in FIG. 11A. As shown in FIG. 11, this compact case 7 has a structure in which, to the rear side, the lid body 20 is attached with a hinge from the inner side to the container body 10, in which the hinge projection 21 of the lid body 20 is assembled to the hinge recessed section 13 of the container body 10.

With the compact case 7 of the seventh embodiment, at one end section (in this example, a right end) of the hinge recessed section 13 of the container body 10 is engaged with the hinge unit 30 in which a top end section 32*a* of the hinge unit is faced to the inner side, and in another end (left end) section is formed an engaging recessed section 18. With the lid body 20, at one end section of the hinge projection 21 is formed a receiving hole 21*a* in which the tip end section 32*a* of the shaft section 32 of the hinge unit 30 is fitted, and at the other end section is formed an engaging projection 24 that engages with the engaging recessed section 18.

Further, as an assembly procedure of the compact case 7 with such a structure, first the container body 10 and the lid body 20 are assembled, and thereafter, as shown in FIGS. 11B and 11C, a frame body 41 is assembled to the container body 10. In that way, a contact section 41*c* at a lower surface of the frame body 41 comes into contact with the hinge unit 30 and covers it from above, and the contact section 41*b* at the lower surface of the frame body 41 comes into contact with an upper section of the engaging projection 24. Thus, the container body 10 and the lid body 20 can be assembled while providing the ability to stop the lid body at any angle.

Eight Embodiment

With the compact cases (1-7) of the above described first to seventh embodiments, the tip end section 32*a* of the hinge unit 30 is made into an inclined shape to ensure ease in assembling and strength after the assembling. In comparison with the above, with a compact case of an eight embodiment of this invention that will be described hereinafter, it is an embodiment in which use of hinge units each having a square tubular shaft section similar to a typical hinge unit are also adapted. Then, while ensuring strength and accuracy after the assembling, the assembling is made easier. Of course, the cost regarding the mold can also be decreased, without the use of a complex and large mold. Below, the compact case of the eighth embodiment is described regarding its structure and configuration and assembly procedures and the like.

<Exterior Shape>

Figure 12A:
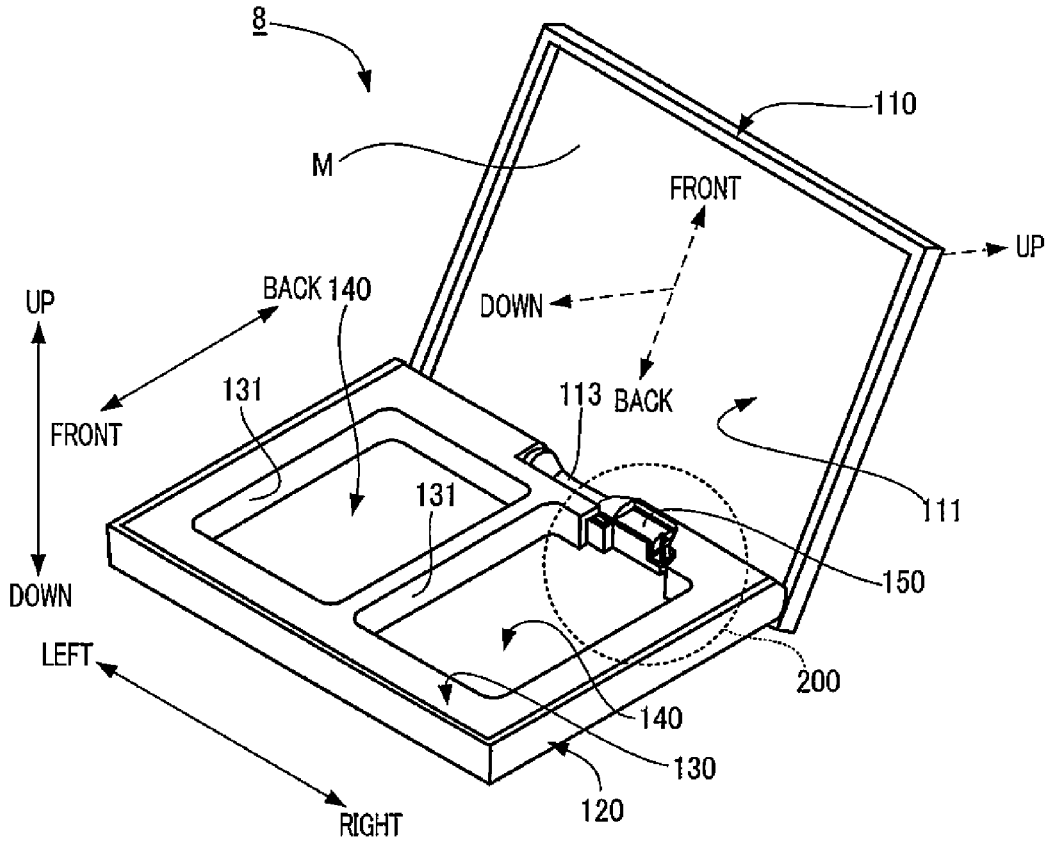
FIGS. 12A-12B are perspective views of a compact case of an eighth embodiment of this invention.
Figure 12B:
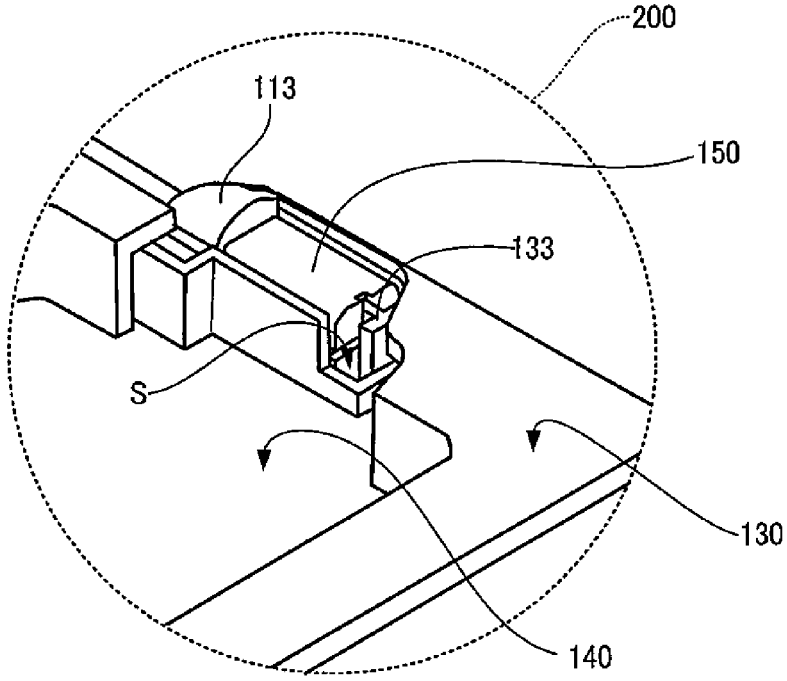

FIG. 12 is an external view of the compact case 8 of the eighth embodiment of this invention. In FIG. 12, the compact case 8 in a state with a lid body 110 open is shown. Note that, FIG. 12A is a partially cutaway perspective view of the compact case 8, and FIG. 12B is an enlarged view of a cutaway section shown in a circle 200 in FIG. 12A. As shown in the figure, the outer appearance of the compact case 8 of the eighth embodiment is similar to the compact cases in the above first to seventh embodiments. The compact case of this embodiment includes a flat box-shaped container body 120 having a storage space 140 for cosmetics and cosmetic tools and a lid body 110 connected to the container body 120 via a hinge using hinge units 150 to cover an opening of the container body 120 in an openable and closable manner.

<Structure>

Figure 13:
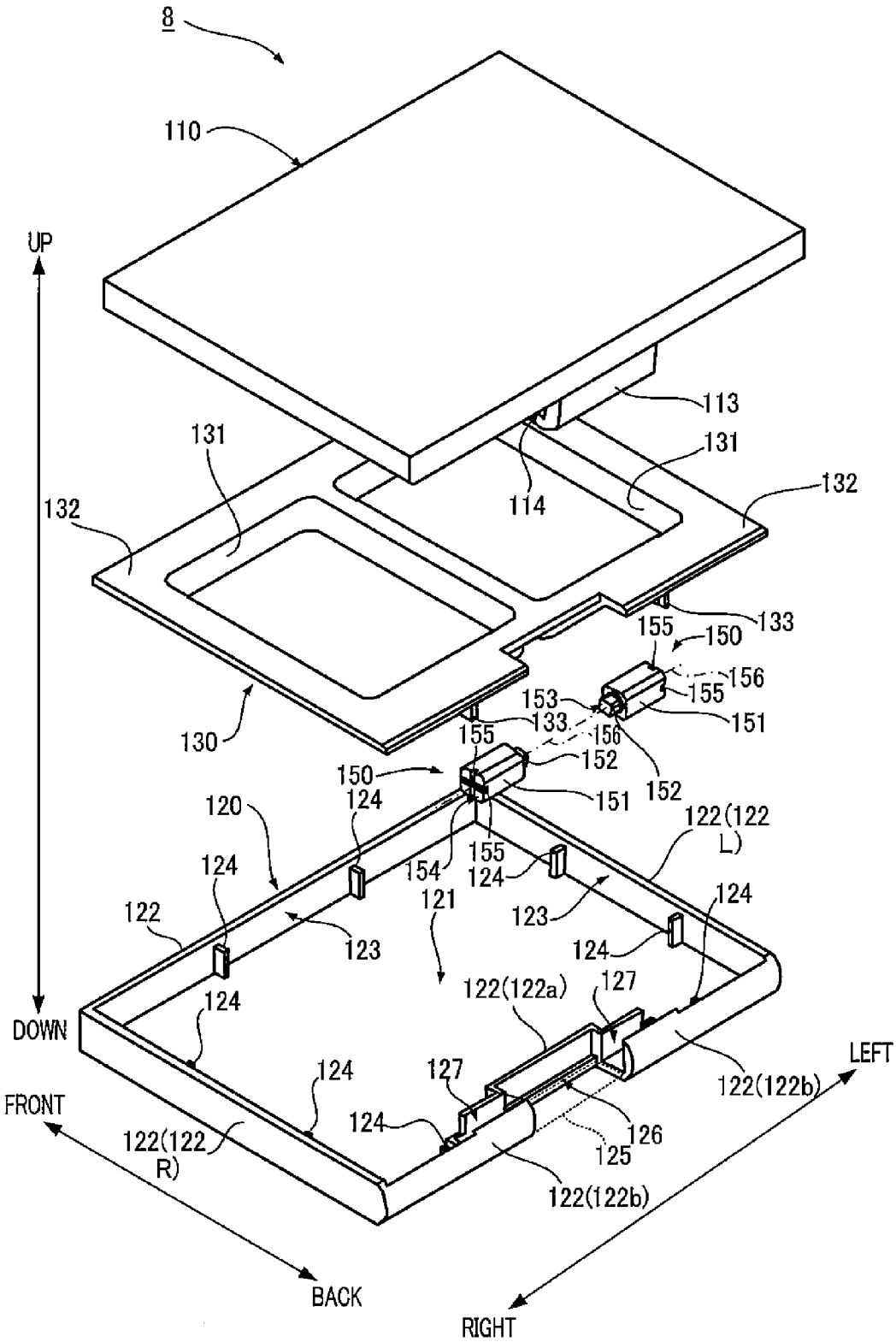
FIG. 13 is a fragmented perspective view when the compact case of the eighth embodiment is seen from an upper back side.
Figure 14:
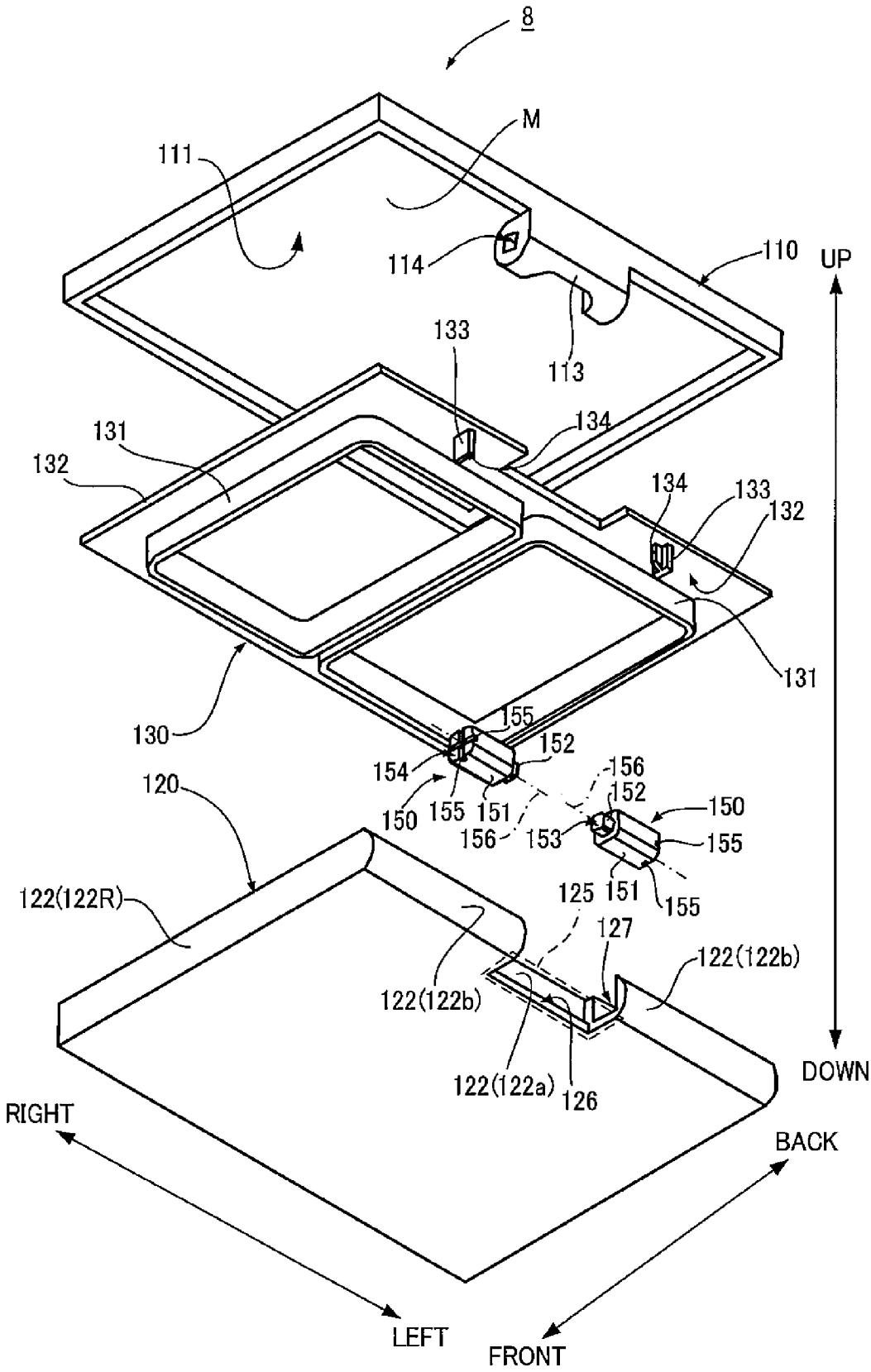
FIG. 14 is a fragmented perspective view when the compact case of the eighth embodiment is seen from a lower back side.

FIGS. 13 and 14 show a cutaway perspective view of the compact case 8 of the eighth embodiment. FIG. 13 is a perspective view seen from an upper back side, and FIG. 14 is a perspective view seen from a lower back side. The compact case 8 is a thin flat box shape, and comprises a container body 120 for storing cosmetics and cosmetic tools, a lid body 110 for covering in an openable and closable manner the upper opening of the container body 120, hinge units 150 for connecting the lid body 110 to the lid body 120 in an openable and closable manner, and a frame body 130 to be attached to an upper surface of the container body 120 along an opening shape of the container body 120. Note that, in this embodiment, the hinge is structured using two hinge units 150.

The frame body 130 has a basic structure in which a plate shaped member is integrally formed with at least a flat square hollow frame section 131 that opens upwards. In this embodiment, the frame section 131 is open upwards and downwards and the periphery of the upper side is made flush with a plate section 132. Further, two frame sections 131 are formed in parallel to the left and right, and each frame section 131 forms a space 140 for storing cosmetics and cosmetic tools when a lower end of each frame section 131 comes into contact with a bottom surface of the container body 120. Of course, the frame body 131 can be formed with a bottom section to the lower side, and there can be formed just one or three or more bottom sections.

Further, on a back end lower surface of the frame body 130 is provided drooping two thin plate-shaped tongue pieces 133 separated to the left and right directions and facing each other. Further, these two tongue pieces 133 are each formed with guide engaging section 134 that extends in the up-down direction on sides opposing each other. In the illustrated example, there are formed the rib-shaped protrusions (guide protrusions) 134 each intersecting with a surface of the tongue piece 133. Therefore, the horizontal sectional shape of each tongue piece 133 is substantially a T shape. These guide protrusions 134 are references to arrange the two hinge units 150 accurately on the same axis.

Figure 15A:
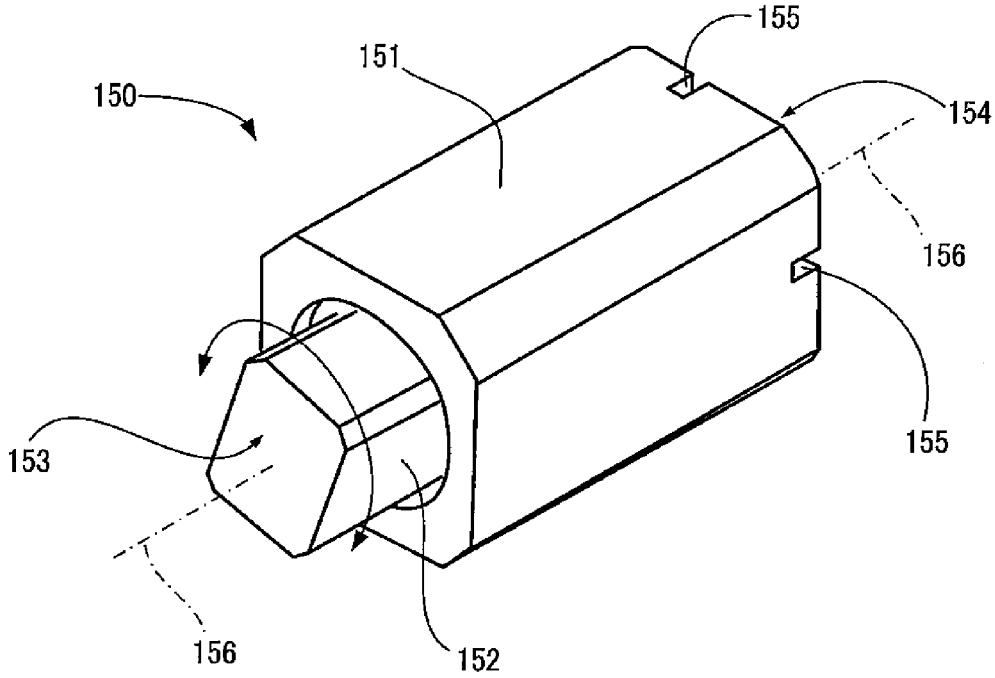
FIGS. 15A-15B are enlarged views of a hinge unit structuring the compact case of the eighth embodiment.
Figure 15B:
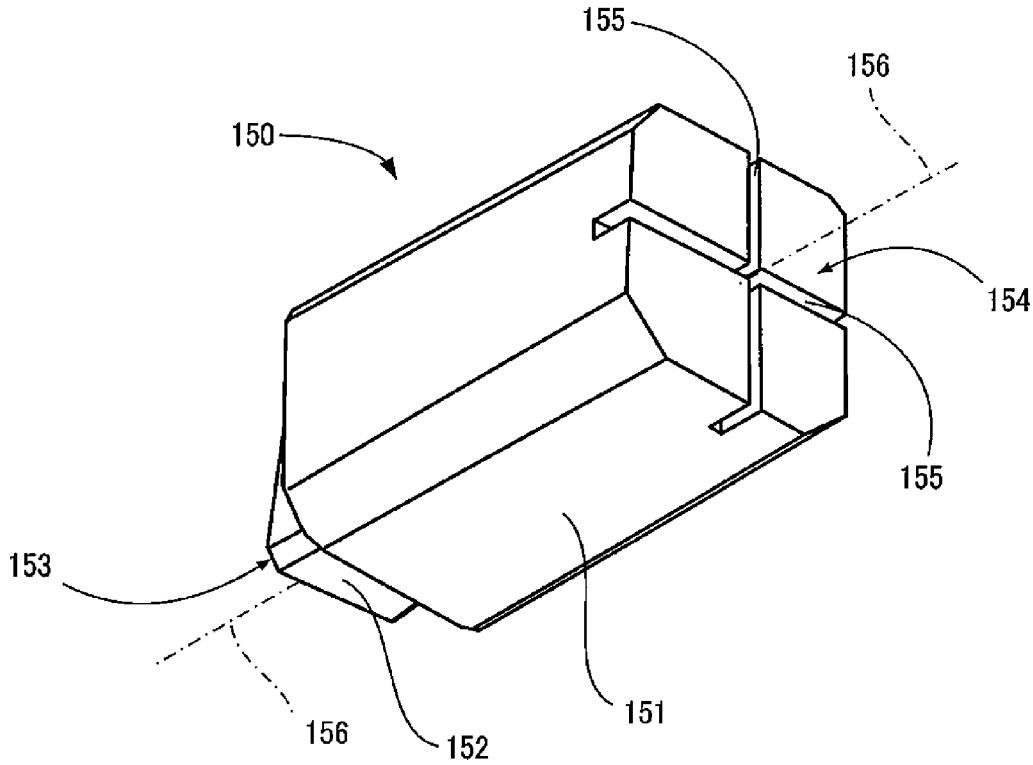

The hinge units 150 are primary components structuring the hinge, and each has a similar shape, structure, configuration as a typical hinge unit. That is, each hinge unit has an outer shape in which a shaft section 152 is protruded in one end surface side of the tubular case section 151 and contains in the tubular case section a rotational torque controlling mechanism made of multiple components. FIG. 15 shows an enlarged view of the hinge unit 150. FIG. 15A is a perspective view when the hinge unit 150 is seen from the tip end surface 153 of the shaft section 152, and FIG. 15B is a perspective view when seen from the end surface (below, distal end surface) 154 in which the shaft section 152 is not protruded from. As shown in the figures, each hinge unit 150 used for the compact case 8 of the eighth embodiment includes a square tubular case section 151 having a substantially square end surface that has been beveled at the corners and a square tubular shaft section 152 having a substantially square end surface shape that has been beveled at the corners similar to the case section 151. The tube axis of the case section 151 and the shaft section 152 are matched with a rotating axis 156 of the shaft section 152. Note that, an internal structure of the case section 151 is approximately the same structure as the hinge unit 30 used in the compact cases (1-7) of the above-mentioned first to seventh embodiments. That is, the shaft section 152, with an integrated rotational torque controlling mechanism, is to be urged to a predetermined rotational angle in a predetermined direction, when the rotational angle is in a predetermined angle range in respect to the case section 151. Further, the shaft section 152 is connected to a spring mechanism in the case section 151, and is made to retract to the distal end surface side when a pressure toward the distal end surface 154 is added to the tip end surface 153.

By the way, when the two hinge units 150 are assembled in the compact case 8, for example, when the hinge units are assembled while the lid body 110 is in a closed state or maintained in an open state at a predetermined angle, in case that the rotating angel of the shaft section 152 with respect to the case section 151 is considered as an initial position to be a reference of the rotating action of the shaft section 152, even when the case section 151 is rotated around the axis in any way, the opening and closing action of the lid body 110 is not influenced. Namely, if the initial position is an origin, since the rotational angle of the shaft section 152 with respect to the case section 151 always becomes the same, the lid body 110 is urged to a predetermined direction with a predetermined opening and closing angle based on the rotating torque controlling mechanism. Therefore, when assembling, as long as the above initial position is kept, assembling can be performed without having to pay much attention to each of the two hinge units 150. However, the hinge units 150 of the pair need to be arranged accurately on the same axis. Thus, in this embodiment, the distal end surface 154 of each hinge unit 150 is formed with guide sections 155 that pass the rotational axis 156 of the shaft section 152 and that cross the distal end surface 154.

However, the two hinge units 150 cannot be accurately arranged on the same axis only by the guide sections 155 of the hinge units 150. Therefore, the tongue pieces 133 of the frame body 130 are provided with the guide projections 134, as a reference to arrange the two hinge units 150 on the same axis. When the guide projections 134 engage to the guide sections 155 of the two hinge units 150 arranged facing each other, they are both arranged accurately on the same axis. Note that, in this embodiment, each guide section 155 is in a groove state that engages with the guide protrusion 134 protruding from the tongue piece 133. Further, the guide sections (hereafter, guide groove) 155 are formed in a cross shape that halves each side of the substantially square shape of the distal end surface 154 of the case section 151. The case section 151 and the shaft section 152 are a square tubular shape with similar end surface shapes and are on the same axis as the rotational axis 156, because the guide grooves 155 that extend so as to halve the sides opposed to each other always pass the rotational axis 156. Further, the reason that the guide grooves 155 are made as a cross shape is because however the hinge unit 150 is arranged around the rotational axis, it does not affect the opening-closing action of the lid body 110 as described above, and thus in the case any side surface of the square tubular case section 51 is placed on the horizontal surface, one of the two guide grooves 155 structuring the cross will always face in the up-down direction.

The container body 120 is a thin flat box shape formed by surrounding a periphery of the substantially rectangular bottom surface 121 with a peripheral wall 122 provided standing upwards. On the inner surface 123 of the peripheral wall 122 are formed in various places ribs 124 extending in the up-down direction with surfaces orthogonal to the inner surface 123 inwards of the container body 120. The ribs 124 have a function to reinforce the thin container body 120, and also serve to support from below the frame body 130 to maintain the upper surface of the frame body 130 horizontally, by the upper ends coming into contact with the peripheral lower surface of the plate shaped section 132 of the frame body 130, when the frame body 130 is fitted in from above the container body 120.

Further, in the back end center of the bottom surface 121 is formed a hinge recessed section 125 cut out in a rectangle. To both the left and right sides of the hinge recessed section 125 are formed the hinge storing sections 127. In this embodiment, the peripheral wall 122*a* provided standing along a bottom side 126 bends at both left and right ends toward the back end side, bends in the left-right direction midway to the back end, bends to the back end side midway to the peripheral walls to the left and right ends (122L, 122R) and connects to the back end side peripheral wall 122*b*. Thus, to the left and right of the back end recessed section 125 of the bottom surface 121 are formed regions 127 spaced apart and partitioned into a rectangle with three wall surfaces provided standing upwards, and these regions become the hinge storing sections 127. In opposing surfaces of the two hinge storing sections 127 that are spaced apart to the left and right there are no peripheral walls 122, and the sections are open, and the hinge units 150 are stored in the hinge storing sections 127 so that the shaft sections 152 are free to protrude from the openings.

On a back surface 111 of the lid body 110, namely a lower surface 111, is adhered a mirror M. In the back end center is formed the hinge projection 113 forming a part of the hinge. The length to the left and right of the hinge projection 113 approximately matches the length to the left and right of the hinge recessed section 125 of the container body 120, namely the spaced apart distance between the above openings of the two hinge storing sections 127. In both the left and right ends of the hinge projection 113 are formed substantially square receiving holes 114 in which the shaft sections 152 of the hinge units 150 are to be fitted. Of course, the receiving holes 114 are not through holes and have a recessed shape, and the receiving holes are easily shaped in a mold compared to through holes, even if these parts 114 are formed using a slide mechanism and the like. In this embodiment, at least, with the parts other than the receiving holes 114 of the lid body 110 in the hinge section in which the hinge units 150 are to be incorporated, there is no need to form the mold with an inclined pin or a slide mechanism. Therefore in the compact case 8 of this embodiment, the structure of the mold to manufacture the components becomes simpler than conventional ones, and the cost of the mold itself and faults in the mold can be decreased, and the cost relating to the mold can be significantly reduced.

<Assembling Procedure>

Figure 16:
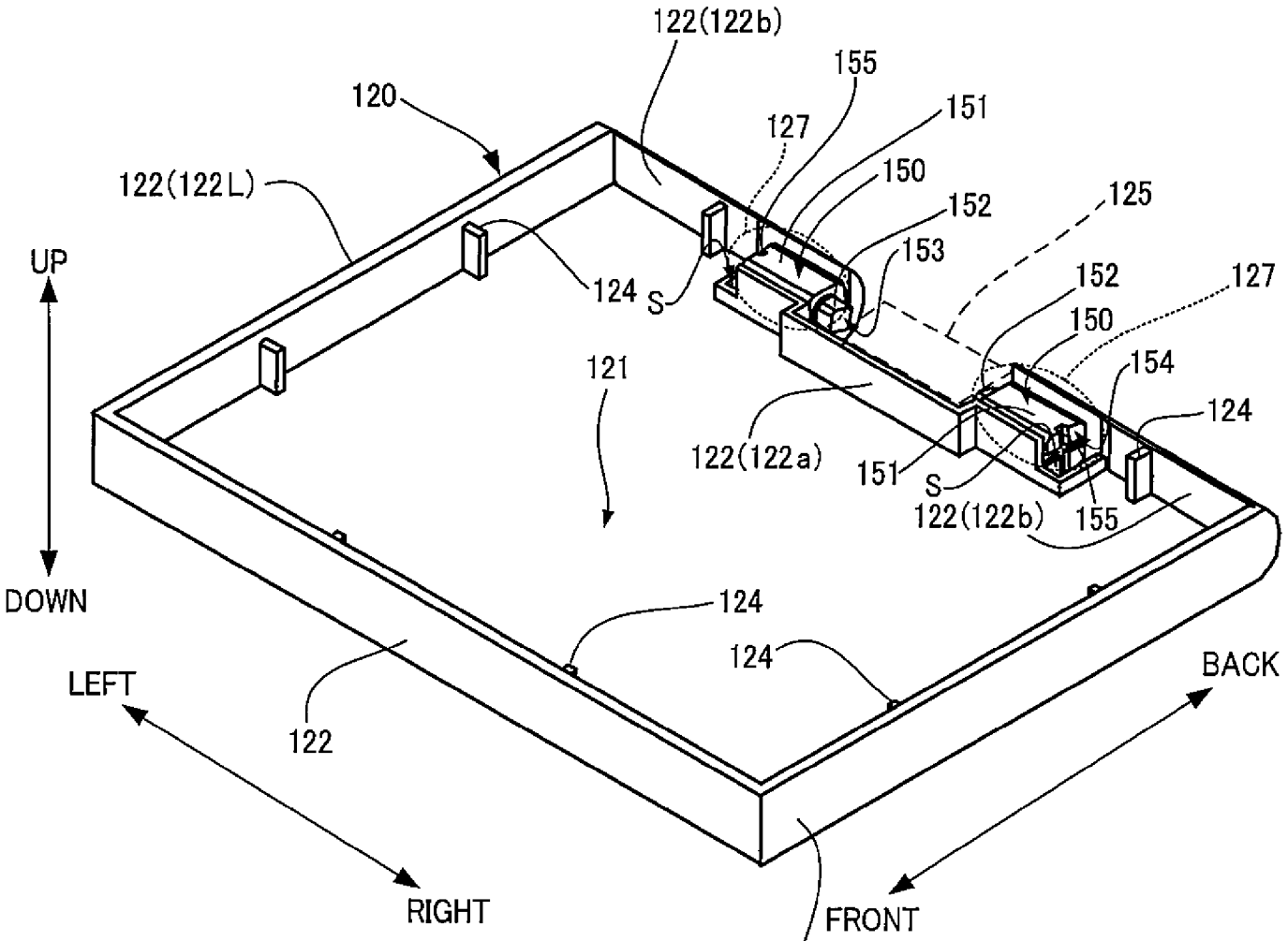
FIG. 16 is a perspective view showing a first state in an assembling process of the compact case of the eighth embodiment.
Figure 17:
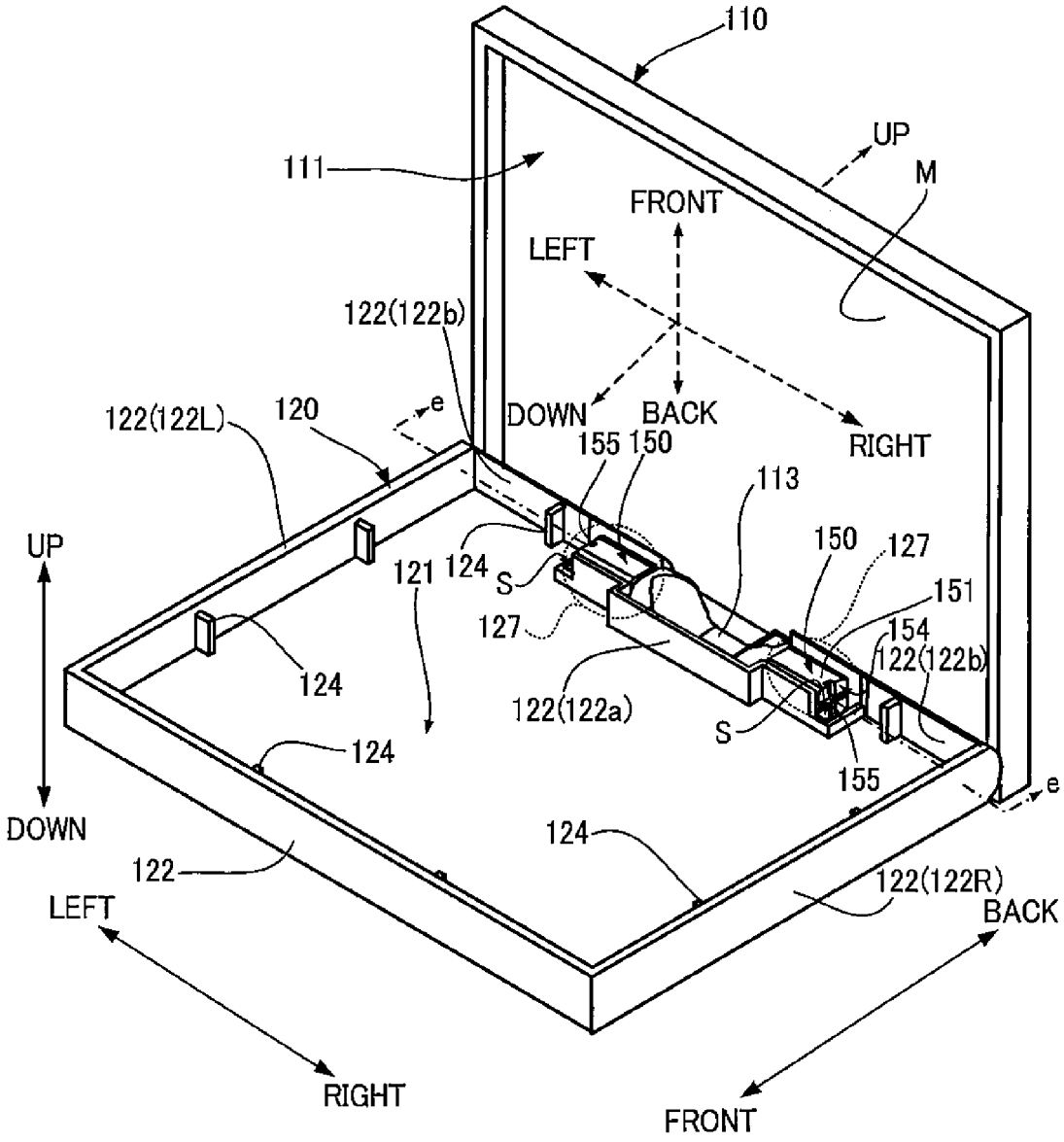
FIG. 17 is a perspective view showing a procedure in a second state in the assembling process of the compact case of the eighth embodiment.
Figure 18:
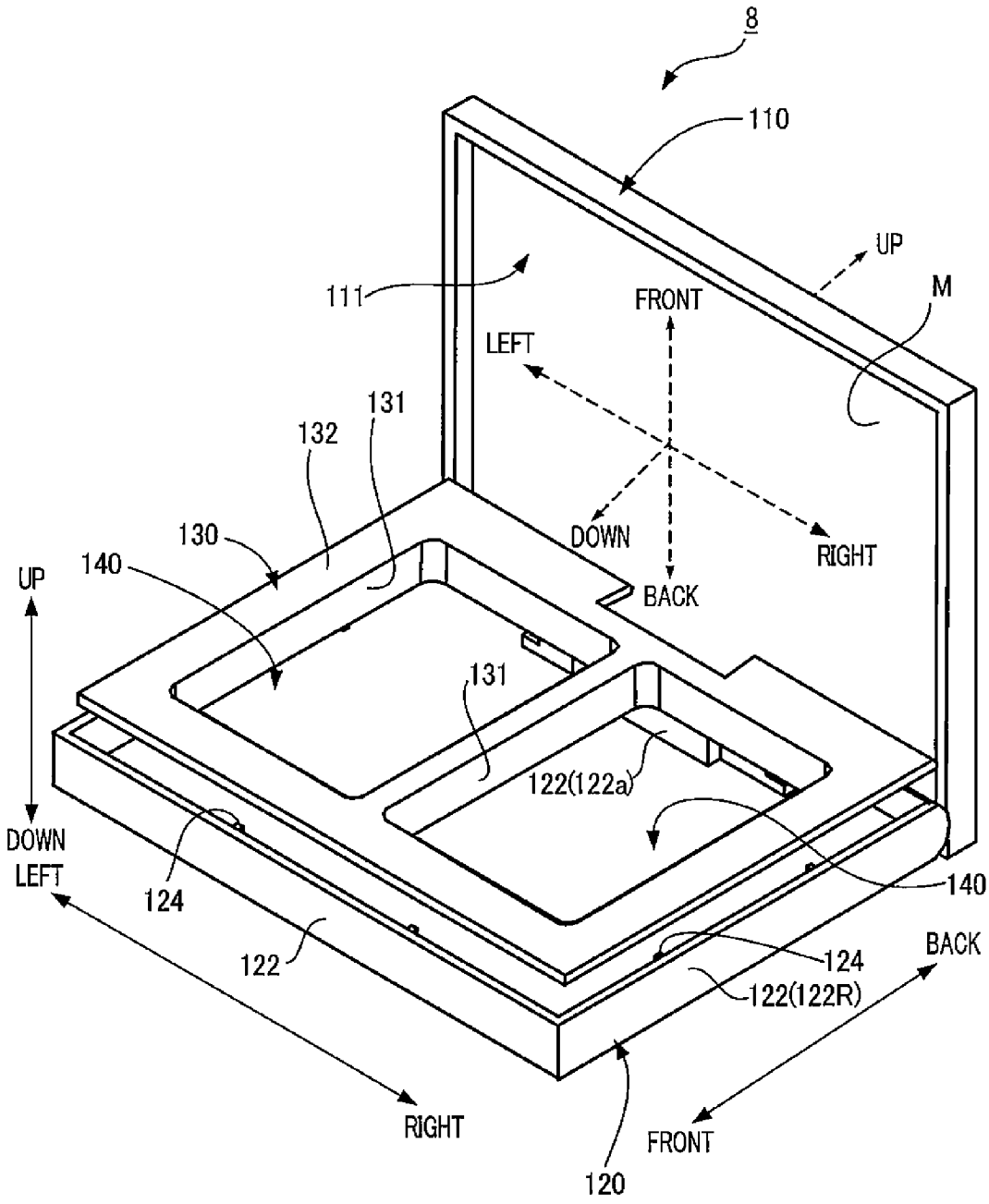
FIG. 18 is a perspective view showing a third state in the assembling process of the compact case of the eighth embodiment.

The general structure of each part structuring the compact case 8 of the eighth embodiment has been described above. Next, details of positional relationships of each parts and incorporating states with the compact case 8 are described, while following the assembling procedure of the compact case 8. FIGS. 16 to 18 show the assembling procedure of the compact case 8. First, the two hinge units 150 opposed to one another in the tip end surfaces 153 are stored in the two hinge storing sections 127 of the container body 120 (FIG. 16). Here, each hinge unit 150 is arranged so that an extending direction of either one guide groove 155 of the two guide grooves 155 formed in a cross shape in the distal end surface 154 is made to match the up-down direction. In this embodiment, the case section 151 of the hinge unit 150 has a substantially square end surface shape, and when the case section 151 is stored in the hinge storing section 127, one of the four side surfaces of the case section 151 contacts the bottom surface 121 of the horizontal container body 120, and naturally the extending direction of any one of the guide grooves 155 matches the up-down direction. Further, when the hinge unit 150 is stored in the hinge storing section 127 defined by the front and back wall surfaces of the hinge storing section 127, movement to the front and back and the rotation of the case section 151 around the axis is restricted. Further, the left and right outer wall surfaces of the left and right hinge storing section 127 restrict the movement of the hinge unit in the left-right directions.

Next the hinge projection 113 of the lid body 110 is placed adjacent to the hinge storing section 127. In this embodiment, the two hinge units 127 corresponding to the two hinge units 150 are formed spaced apart to the left and right, and the hinge projection 113 of the lid body 110 is inserted in the above recessed section 125 of the bottom surface 121 of the container body 120. At this time, the receiving holes 114 are arranged so as to be approximately coaxial with each of the hinge units 150 stored in each of the two hinge storing sections 127. Further, the shaft sections 152 of the two hinge units 150 are each preliminary rotated by the same angle in respect to the initial positions so as to be in mirror symmetry. Of course, both shaft sections can stay in the initial positions. The lid body 110 is inserted between the two hinge units, so as to be in an opening-closing angle corresponding to the shaft sections 152 when in this angle position (FIG. 17). In this figure, the lid body 110 is inserted in a 90 degrees open state. Note that, the length to the left and right of the hinge storing section 127 is longer than the case section 151 and have play to the left and right, and when the hinge projection 113 of the lid body 110 is inserted between the two hinge units 150, the left and right hinge units 150 can each "escape" to of the left and right directions. Namely, by having the moving space S described in the fourth and fifth embodiments, the lid body 110 can be easily incorporated to the container body 20 without any problems. Further, in this embodiment, the shaft section 152 itself is also movable to the distal end surface 154, thus the assembling work of the lid body 110 and the container body 120 is made much easier.

Figure 19A:
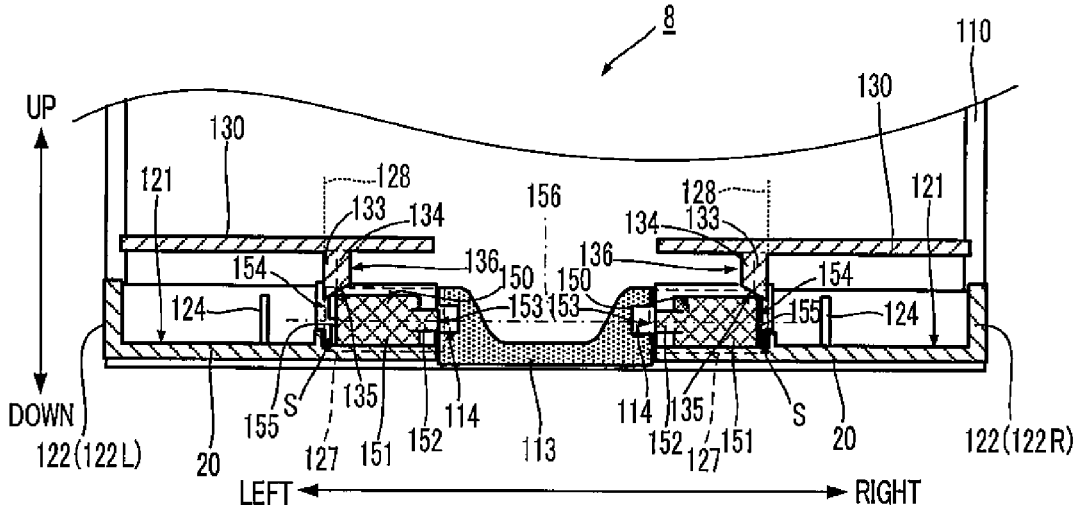
FIGS. 19A-19C are sectional views showing the state of processes from the above third state to when the assembly of the compact case is completed.
Figure 19B:
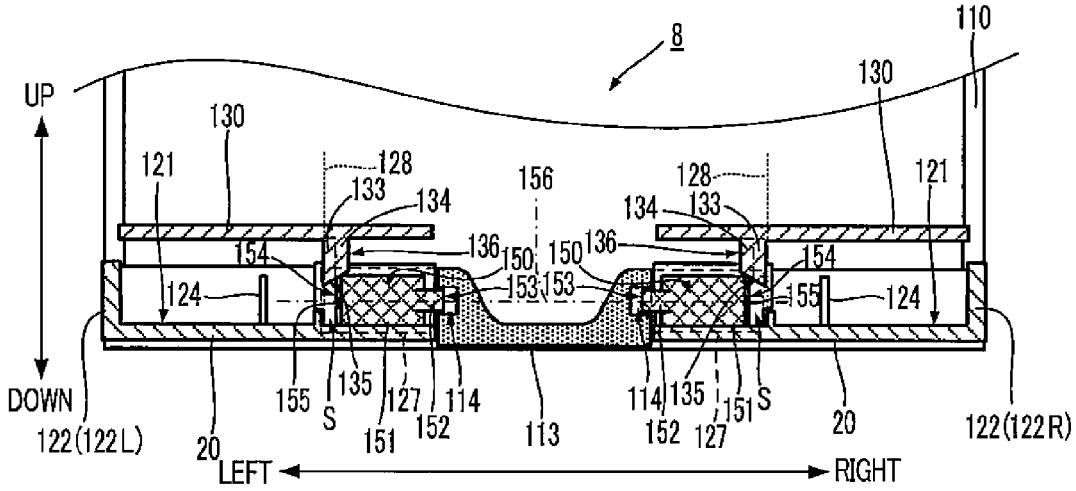
Figure 19C:
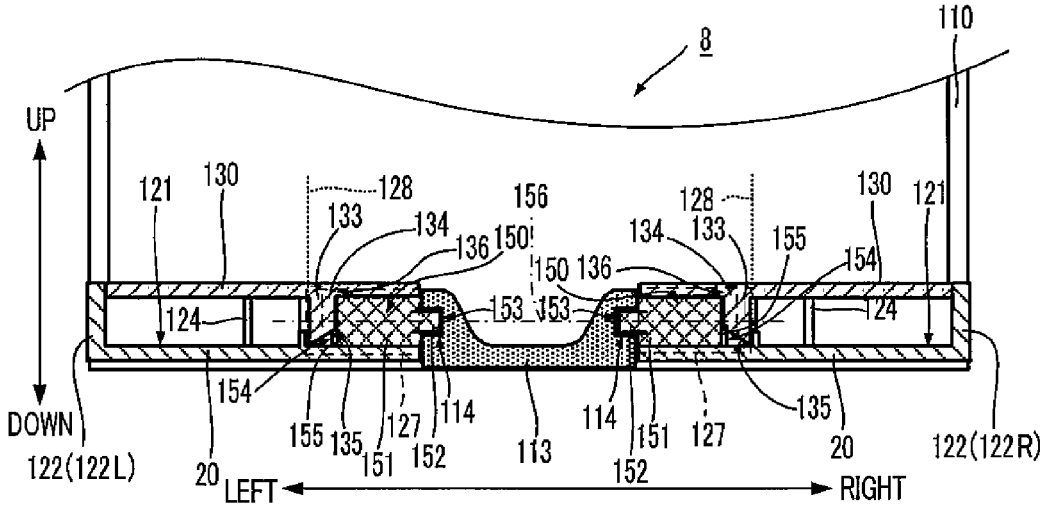

Lastly, as shown in FIG. 18, the frame body 130 is fitted in the container body 120 from above. FIGS. 19A to 19C show the transitional state of each part when, after the assembling procedure shown in FIG. 18, the frame body 130 is fitted into the container body 120. Note that FIG. 19 corresponds to an e-e arrow section in FIG. 17. When the frame body 130 is pressed into the container body 120 from above, the tongue pieces 133 are inserted in the hinge storing sections 127 along the left and right outer wall surfaces 128 of the hinge storing sections 127 (FIG. 19A). In this embodiment, in the lower end of the guide protrusion 134 is formed as an inclined section 135 in which the protrusion gradually lowers downwardly, and as the frame body 130 is fitted in, the tongue piece 133 is inserted in between each of the distal end surfaces 154 of the hinge unit 150 and the left and right outer wall surfaces 128 of the hinge storing sections 127, each of the guide protrusions 134 engages with the guide groove 155, and each of the left and right hinge units 150 are guided by the inclined section 135 and urged to the inner side in the left and right (FIG. 19B). Note that, the downward inclination of the tongue piece 133 can be provided at the side when the tongue piece comes to contact the left and right wall surfaces 128 of the hinge storing section 127. Thus, the tongue piece 133 can be more smoothly inserted to the inner side of the hinge storing section 127.

Then, in the state that the frame body 130 is completely fitted into the container body 120, the guide grooves 155 engage with the wide section 136 further above the inclined section 135 of the guide protrusion 134, and the hinge units 150 are further pressed in to the left and right inner sides. Thus, the shaft sections 152 are inserted deeply into the receiving holes 114 of the lid body 110, and falling off of the hinge units 150 is certainly prevented. Then, the guide projections 134 extending in the up-down direction are engaged to the guide grooves 155 formed to pass the rotational axis in the distal end surface 154 of the hinge unit 150, thus the two left and right shaft sections 152 are adjusted in position in the up-down direction by the horizontal bottom surface 121 of the container body 120 and also adjusted in position in the left-right direction, and the two hinge units 150 are positioned accurately on the same axis. Note that, in the case the frame body 130 is completely fitted into the container body 120, both parts can be fixed by an appropriate method. For example, both parts can be adhered at places where they contact each other using a known ultrasonic welding. Alternatively, a structure that mechanically engages to both parts may be formed.

In this way, with the compact case 8 of the eight embodiment, the assembling process is performed by the work of "merely placing" or piling the composing parts in the up-down direction, and the assembling cost can be significantly decreased. Further, since the tongue pieces and the back end surfaces 154 of the hinge units 150 are configured to engage, the hinge unit 150 can be prevented from "turning together" which means that the hinge unit 150 rotates together with the opening and closing of the lid body 110. Further, since the wall surfaces 128 at the back sides of the hinge units 150 structuring the hinge storing sections 127 of the container body 120 restrict the movement of the tongue pieces to the left and right directions, the tongue pieces 133 do not bend when the lid body 110 is opened and closed. Namely, the assembled state of the hinge units 150 engaging the tongue pieces 133 do not become loose or rattle. Of course, the shaft sections 152 do not fall out of the receiving holes 114.

Modified Example

With the compact case 8 of the above eighth embodiment, the compact case 101 using two hinge units 150 were shown, but of course there can be one hinge unit 150. In this case, one hinge unit and the hinge storing section 127 corresponding to the hinge unit 150, and the receiving hole 114 of the hinge projection 113 can be replaced with a similar hinge structure as in the above third to seventh embodiments.

With the above compact case 8 of the eighth embodiment, two hinge units 150 are arranged such that the tip end surfaces 153 of the shaft sections 152 oppose each other, but of course, it is possible to change such that the back end surfaces 154 are opposed to each other as in the compact cases (2, 3, 4, 6) in each of the second, third, fourth, and sixth embodiments.

The guide grooves 155 of the hinge unit 150 are not limited to a cross shape as long as it passes the rotational axis 156, and the groove may be one groove. In this case, the hinge unit 150 may be stored in the hinge storing section 127 so that the one groove faces in the up-down direction. The guide groove 155 does not have to cross the distal end surface 154, and can stop midway. In this case, the hinge unit 150 can be stored in the hinge storing section 127 with the side of the groove 155 which is open to the upper side.

The guide grooves 155 do not have to be a linear shape with a certain width, but can be a shape that gradually widens, for example, a substantially V-shape. Then, the front shape of the guide engaging section 134 when seen from the left and right can be a V-shape that engages the V-shaped guide groove.

The end shape of the hinge unit 150 is not limited to a substantially square shape, and can be any shape that is partitioned by the hinge storing section 127 and that the guide groove 155 can be formed on the distal end surface 155 so as to pass the rotational axis 156 thereof. For example, even if the bottom surface 121 of the container body 120 is inclined to the front and back in respect to the horizontal surface in the hinge storing section 127, the guide groove 155 can be formed in a direction matching that inclination. In any case, when the hinge unit 150 is stored in the hinge storing section 127, the extending direction of the guide groove 155 should match the up-down direction.

The engaging structure of the guide section 155 of the hinge unit 150 and the guide engaging section 154 of the frame body 130 is not limited to a structure in which the guide section 155 is a groove and the guide engaging section 134 is a projection as in the above embodiments. For example, the structure can be changed so that a rib-shaped projection that runs vertically in the distal end surface 154 of the hinge unit 150 through the rotational axis 156 can be formed, and the groove that engages the rib-shaped projection is formed to the tongue piece 133 of the frame body 130. Note that, in such a case, in order to certainly fit the shaft sections 52 of the hinge units 150 in the receiving holes 114 of the hinge projection 113 of the lid body 110, an inclined section can be formed on the rib-shaped projection of the hinge unit 150 in such a manner that the protrusion gradually sharpened toward the upper end of the rib.

Note that, with the compact cases 1 to 8 of the above embodiments including the eight embodiment, the structure was such that one or two hinge units (30, 150) were used, but a structure in which three hinge units comprising one pair of hinge units and one hinge unit can be used or four hinge units made of two pairs of hinge units can also be used.

REFERENCE SIGNS LIST

M mirror, S space, 1-8 compact case built-in with a hinge unit, 10, 120 container body, 11, 14, 127 hinge storage section, 12 mesh hole, 13, 15, 125 hinge recessed section, 16, 21, 22, 113 hinge projection, 17, 24 engaging projection, 18, 23 engaging recessed section, 20, 110 lid body, 21*a*, 22*a*, 114 receiving hole, 24*a* hemispheric section, 24*b* columnar section, 30, 150 hinge unit, 31, 151 case section, 32, 152 shaft section, 32*a* tip end section of shaft section, 33 rib for hinge unit, 41, 130 frame body, 41*a* engaging hook, 41*b* contact section, 41*b*1 sliding groove, 41*c* contact section, 42 cosmetic plate, 121 bottom surface of container body, 122 peripheral wall, 122*a* peripheral wall of hinge recessed section bottom side, 122*b* peripheral wall of back end, 1221 peripheral wall of left end side, 122*r* peripheral wall of right end side, 124 rib of container body, 131 frame body, 132 plate-like section, 133 tongue piece, 134 guide engaging section (guide protrusion), 140 storing space, 153 tip end surface of shaft section, 154 back end surface of hinge unit, 155 guide section (guide groove), 156 rotational axis of shaft section

The invention claimed is:

1. A compact case built-in with a hinge unit, comprising a flat box shaped container body that stores cosmetic in a lower bottom part, a lid body connected to a back end of the container body by a hinge using at least one or more hinge unit, the lid body covering an upper opening of the container body in an openable and closable manner, the lid body being urged in a predetermined direction up to a predetermined opening and closing angle with a rotating torque controlling mechanism built-in the hinge unit, the compact case further comprising a frame body to be fixed to the container body, which is made of a plate-like member having a flat peripheral shape to cover the upper opening of the container body;

wherein a shaft section of the hinge unit protrudes in an axial direction from a tip end side of a case section, wherein a hinge storing section for storing the case section of the hinge unit is provided at a back end side of the container body and partitioned with wall surfaces so that the shaft section is made to protrude therefrom, wherein a receiving hole is formed to the back end of the lid body into which the shaft section of the hinge unit is to be inserted, wherein the case section of the hinge unit is stored in the hinge storing section, the frame body is attached to the container body so as to cover up the hinge storing section, and the case section of the hinge unit is fixed to the container body, and wherein the shaft section of the hinge unit is inserted in the receiving hole, and the container body and the lid body are connected in the openable and closable manner.

2. The compact case built-in with a hinge unit according to claim 1, wherein the hinge storing section is partitioned with wall surfaces standing upwards.

3. The compact case built-in with a hinge unit according to claim 1, wherein the shaft section is formed with an inclined surface in a downward direction toward a tip end;

an inside of the receiving hole is formed in a shape corresponding with the shape of the inclined surface; and the inclined surface of the shaft section is facing a direction in which the lid body is fitted to the container body, so as to insert the shaft section of the hinge unit in the receiving hole in an assembling process.

4. The compact case built-in with a hinge unit according to claim 2, wherein the hinge unit has the shaft section protruding in an axial direction from a tip end of the case section, and a guide section at a distal end surface thereof which extends in a crosswise direction while passing through a rotational axis of the shaft section, wherein a plate-shaped tongue piece extending in a front-back up-down direction is provided suspending on a back end lower surface of the frame body, the tongue piece having a guide engaging section extending in the up-down direction and engaging with the guide section, wherein the receiving hole is provided at the back end of the lid body in which the shaft section is to be inserted, wherein the hinge storing section stores the hinge unit with the tip end surface in a state opposed to an opening of the receiving hole, and the tongue piece is inserted in a state with the guide engaging section engaged to the guide section in the distal end surface of the hinge unit, and the hinge unit has the shaft section inserted in the receiving hole in a state urged to the tip end side.

5. The compact case built-in with a hinge unit according to claim 1, wherein a hinge structure comprises a section connected with an engagement of the hinge unit, and another section connected with an engagement of an engaging projection and an engaging recess.

6. The compact case built-in with a hinge unit according to claim 5, wherein the engaging projection is formed on a flexible piece which is placed on the container body along a rotating surface through which the lid body rotates by the hinge structure.

7. The compact case built-in with a hinge unit according to claim 6, wherein the frame body is provided with a contact portion at the back surface thereof which fills a space adjacent to the flexible piece.

8. The compact case built-in with a hinge unit according to claim 5, wherein the engaging projection is formed with a columnar section on a side surface thereof, and the back surface of the frame body is formed with a contact section that comes into contact with the columnar section when assembling.

9. The compact case built-in with a hinge unit according to claim 4, comprising two hinge units wherein, the tongue pieces are formed on the back end lower surface of the frame body spaced apart to the left and right and facing each other, and the guide engaging section is formed on each tongue piece, the lid body has the receiving hole in each of the left and right of the back end, the container body has two hinge storing sections spaced apart to the left and right at the back end thereof, the two hinge storing sections individually store the two hinge units such that the tip ends are facing each other or that the distal end surfaces are facing each other, each hinge unit being inserted in the receiving hole so that each shaft section is coaxial with one another.

10. The compact case built-in with a hinge unit according to claim 4, wherein the guide engaging section is a protrusion extending downwards, and the guide section is a groove extending in the up-down direction in a state stored in the hinge unit section.

11. The compact case built-in with a hinge unit according to claim 10, wherein the guide engaging section has an inclined portion at the lower end thereof which gradually decreases in height of in protrusion toward the lower end thereof.

12. The compact case built-in with a hinge unit according to claim 4, wherein the guide engaging section is a groove that extends downwardly, and the guide section is a protrusion that extends in the up-down direction in a state stored in the hinge unit section.

13. The compact case built-in with a hinge unit according to claim 12, wherein the guide section has an inclined section which gradually decreases in height in protrusion toward the upper end thereof.

14. The compact case built-in with a hinge unit according to claim 4, wherein the case section and the shaft section of the hinge unit are arranged coaxially, and both are square tubular shapes having a substantially square end surface, and the guide section is formed in a cross shape so as to halve each side of the substantially square shape of the case section.

15. The manufacturing method of a compact case built in with a hinge unit according to claim 1 or 2, comprising steps of:

mounting a case section of the hinge unit to the container body in such a manner that the inclined surface of the tip end portion of the shaft section faces an upper side of the container body; and assembling the lid body to the container body such that the hinge section of the lid body presses the tip end portion of the shaft section from an upper to a back direction.

16. The manufacturing method of a compact case built-in with a hinge unit according to claim 15, further comprising a step of mounting a frame body that stores cosmetics to the container body, after mounting the case section of the hinge unit to the container body or after the assembling step.

17. The manufacturing method of a compact case built-in with a hinge unit according to claim 4, further comprising steps of:

a first step of storing the hinge unit in the hinge storing section so that an extending direction of the guide section faces in the up-down direction;

a second step of assembling the lid body to the container body while opposing the opening of the receiving hole and a tip end of the shaft section of the hinge unit; and a third step of inserting the frame body to the container body by pushing the frame body from above such that the tongue piece is inserted to the hinge storing section and that the guide engaging section is engaged with the guide section of the hinge unit stored in the hinge storing section, whereby the hinge unit is urged toward the direction of the tip end and the tip end of the shaft section of the hinge unit is inserted to the receiving hole.

* * * * *